US009096398B2

(12) United States Patent
Nakagaki

(10) Patent No.: US 9,096,398 B2
(45) Date of Patent: Aug. 4, 2015

(54) SHEET CONVEYING DEVICE, IMAGE FORMING APPARATUS INCORPORATING SAME, AND METHOD OF CONVEYING A SHEET IN THE IMAGE FORMING APPARATUS

(71) Applicant: Toshihiro Nakagaki, Ibaraki (JP)

(72) Inventor: Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/260,562

(22) Filed: Apr. 24, 2014

(65) Prior Publication Data

US 2014/0327207 A1 Nov. 6, 2014

(30) Foreign Application Priority Data

May 2, 2013 (JP) ..... 2013-096841
Feb. 28, 2014 (JP) ..... 2014-038439

(51) Int. Cl.

*B65H 7/06* (2006.01)
*G03G 15/20* (2006.01)
*G03G 15/00* (2006.01)
*B65H 7/12* (2006.01)
(Continued)

(52) U.S. Cl.

CPC ..... *B65H 7/125* (2013.01); *B65H 5/021* (2013.01); *B65H 7/02* (2013.01); *B65H 7/06* (2013.01); *B65H 7/14* (2013.01); *B65H 7/20* (2013.01); *G03G 15/20* (2013.01); *G03G 15/70* (2013.01); *G03G 2215/00548* (2013.01)

(58) Field of Classification Search

CPC ..... B65H 7/06; B65H 7/02; B65H 7/18; B65H 7/20; B65H 7/14; G03G 15/70; G03G 2215/00548

USPC ..... 271/258.01, 259, 258.02, 258.03, 256; 399/21

See application file for complete search history.

(56) References Cited

U.S. PATENT DOCUMENTS 7,484,731 B2 * 2/2009 Gutierrez-Vazquez et al. ..... 271/258.04
7,865,122 B2 * 1/2011 Koyama et al. ..... 399/341
(Continued)

FOREIGN PATENT DOCUMENTS

JP 56137367 A * 10/1981
JP 58198059 A * 11/1983
(Continued)

OTHER PUBLICATIONS

U.S. Appl. No. 14/140,854, filed Dec. 26, 2013.
(Continued)

*Primary Examiner* — Luis A Gonzalez
(74) *Attorney, Agent, or Firm* — Oblon, McClelland, Maier & Neustadt, L.L.P.

(57) ABSTRACT

A sheet conveying device, which is incorporated in an image forming apparatus, includes a fixing device to fix an image to a sheet, a holding/conveying belt device having a plurality of belts to sandwich and convey the sheet to a downstream side from the fixing device, and a first sheet detector to detect whether the sheet exists in the belt device. When the sheet is detected at a paper jam, the fixing device and the belt device are continuously driven. When not detected, driving of the fixing device and the belt device is stopped. A method of conveying the sheet includes detecting the paper jam in the image forming apparatus, detecting the sheet in the belt device or between the fixing device and the belt device, and continuing at least one of the belt device and the fixing device based on a sheet detection result.

20 Claims, 21 Drawing Sheets

(51) Int. Cl.

| | |
|---|---|
| ***B65H 5/02*** | (2006.01) |
| ***B65H 7/20*** | (2006.01) |
| ***B65H 7/14*** | (2006.01) |
| ***B65H 7/02*** | (2006.01) |

(56) References Cited

U.S. PATENT DOCUMENTS

| | | | | |
|---|---|---|---|---|
| 2006/0269301 | A1* | 11/2006 | Ogasawara | 399/21 |
| 2007/0166089 | A1* | 7/2007 | Cho | 399/405 |
| 2010/0008695 | A1 | 1/2010 | Okano et al. | |
| 2011/0030927 | A1 | 2/2011 | Okano et al. | |
| 2011/0052247 | A1 | 3/2011 | Saitoh et al. | |
| 2011/0052248 | A1 | 3/2011 | Nishimura et al. | |
| 2011/0170895 | A1 | 7/2011 | Fujiya et al. | |
| 2012/0061057 | A1 | 3/2012 | Okano et al. | |
| 2012/0070180 | A1 | 3/2012 | Iijima et al. | |
| 2012/0227927 | A1 | 9/2012 | Fujiya et al. | |
| 2012/0263491 | A1 | 10/2012 | Fujiya et al. | |
| 2012/0315069 | A1 | 12/2012 | Ikeda et al. | |
| 2013/0259512 | A1 | 10/2013 | Ikeda et al. | |
| 2014/0044462 | A1 | 2/2014 | Ikeda et al. | |
| 2014/0060782 | A1 | 3/2014 | Ikeda et al. | |

FOREIGN PATENT DOCUMENTS

| | | | |
|---|---|---|---|
| JP | 63272735 | A * | 11/1988 |
| JP | 03164754 | A * | 7/1991 |
| JP | 04276768 | A * | 10/1992 |
| JP | 2011-123254 | | 6/2011 |
| JP | 2012-167844 | | 9/2012 |

OTHER PUBLICATIONS

U.S. Appl. No. 14/140,888, filed Dec. 26, 2013.
U.S. Appl. No. 14/182,734, filed Feb. 18, 2014.
U.S. Appl. No. 14/248,652, filed Apr. 9, 2014.

* cited by examiner

SHEET CONVEYING DEVICE, IMAGE FORMING APPARATUS INCORPORATING SAME, AND METHOD OF CONVEYING A SHEET IN THE IMAGE FORMING APPARATUS

CROSS-REFERENCE TO RELATED APPLICATIONS

This patent application is based on and claims priority pursuant to 35 U.S.C. §119 to Japanese Patent Application Nos. 2013-096841, filed on May 2, 2013, and 2014-038439, filed on Feb. 28, 2014 in the Japan Patent Office, the entire disclosures of which are hereby incorporated by reference herein.

BACKGROUND

1. Technical Field

Embodiments of the present invention relate to a sheet conveying device that includes at least a pair of sheet holding/conveying belts, an image forming apparatus incorporating the sheet conveying device, and a method of conveying a sheet in the image forming apparatus including the sheet conveying device.

2. Related Art

Known image forming apparatuses include a configuration to form a toner image on a sheet-like recording material using electrophotography and to fuse and fix toner to the recording material by causing the recording material to pass through a thermal fixing device. When an image output operation is serially performed and the recording materials are loaded one after another in a sheet discharging part after passing through the thermal fixing device, the toner on the recording material may not harden sufficiently. If the toner is still soft, the toner on the recording material can adhere to a subsequent or different recording material. This defect in printing is referred to as blocking. When blocking occurs, the quality of image formation decreases significantly.

To address this inconvenience, it has been proposed to provide electrophotographic image forming apparatuses including a cooling device therein. The cooling device provides a method of cooling a recording material directly by intaking air from outside with fans or a method of cooling a recording material by causing the recording medium to contact a cooled heat exchanger directly or via a thermal conducting member. By using this configuration, heat exchange is conducted between the heat exchanger and the recording material.

Along with the recent increase in speed of printing, the cooling device increases in size. To cool the toner on the recording material more effectively, Japanese Patent Application Publication No. JP 2012-167844-A discloses a cooling device that includes a pair of endless belts disposed vertically in an image forming apparatus. An air-cooled or liquid-cooled heat exchanger is disposed on an inner circumference of one of the belts to cool the recording material.

However, non-contact areas on the belt in a vicinity of an entrance and an exit of the cooling device do not contact the heat exchanger, and therefore have a higher temperature than contact areas where the heat exchanger contacts the belt. Accordingly, the toner on the non-contact areas is difficult to be hardened, in other words, the toner remains soft. Specifically, the non-contact area on the belt that is separated from a heat exchanger disposed at an extreme downstream side in a sheet conveying direction approaches the entrance of the cooling device disposed closest to the fixing device along with rotation of the belt. Consequently, in the event of a paper jam anywhere in paper paths in the image forming apparatus during an image forming operation (a printing operation), if the recording material remains in the vicinity of the entrance or the exit of the cooling device for a long period, the fresh toner that remains soft can adhere to the belt. Even after the paper jam is cleared, if the image forming operation is resumed in this status, toner sticking marks or streaks are formed on the image formed on the recording material, which results in production of a defect image.

SUMMARY

At least one embodiment of the present invention provides a sheet conveying device including a fixing device to fix an image to a sheet, a holding/conveying belt device having a plurality of belts to convey the sheet discharged from the fixing device to a downstream side of the fixing device in a sheet conveying direction while sandwiching the sheet between the belts, and a first sheet detector to detect whether the sheet exists in the holding/conveying belt device. When the first sheet detector detects the sheet in an event of a paper jam, the fixing device and the holding/conveying belt device are continuously driven for a given time. And when the first sheet detector does not detect the sheet, the fixing device and the holding/conveying belt device are stopped.

Further, at least one embodiment of the present invention provides an image forming apparatus including an image forming part to form an image on a surface of the sheet, and the above-described sheet conveying device.

Further, at least one embodiment of the present invention provides a method of conveying a sheet in an image forming apparatus comprising a fixing device to fix an image to a sheet, a holding/conveying belt device having a plurality of belts to convey the sheet discharged from the fixing device to an downstream side of the fixing device in a sheet conveying direction while sandwiching the sheet between the belts, a first sheet detector to detect whether the sheet exists in holding/conveying belt device; and a controller. The method includes detecting a paper jam in the image forming apparatus, detecting the sheet at either one of a position in the holding/conveying belt device and a position between the fixing device and the holding/conveying belt device, and continuing driving at least one of the holding/conveying belt device and the fixing device when the sheet exists at either one of the position in the holding/conveying belt device and the position between the fixing device and the holding/conveying belt device.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
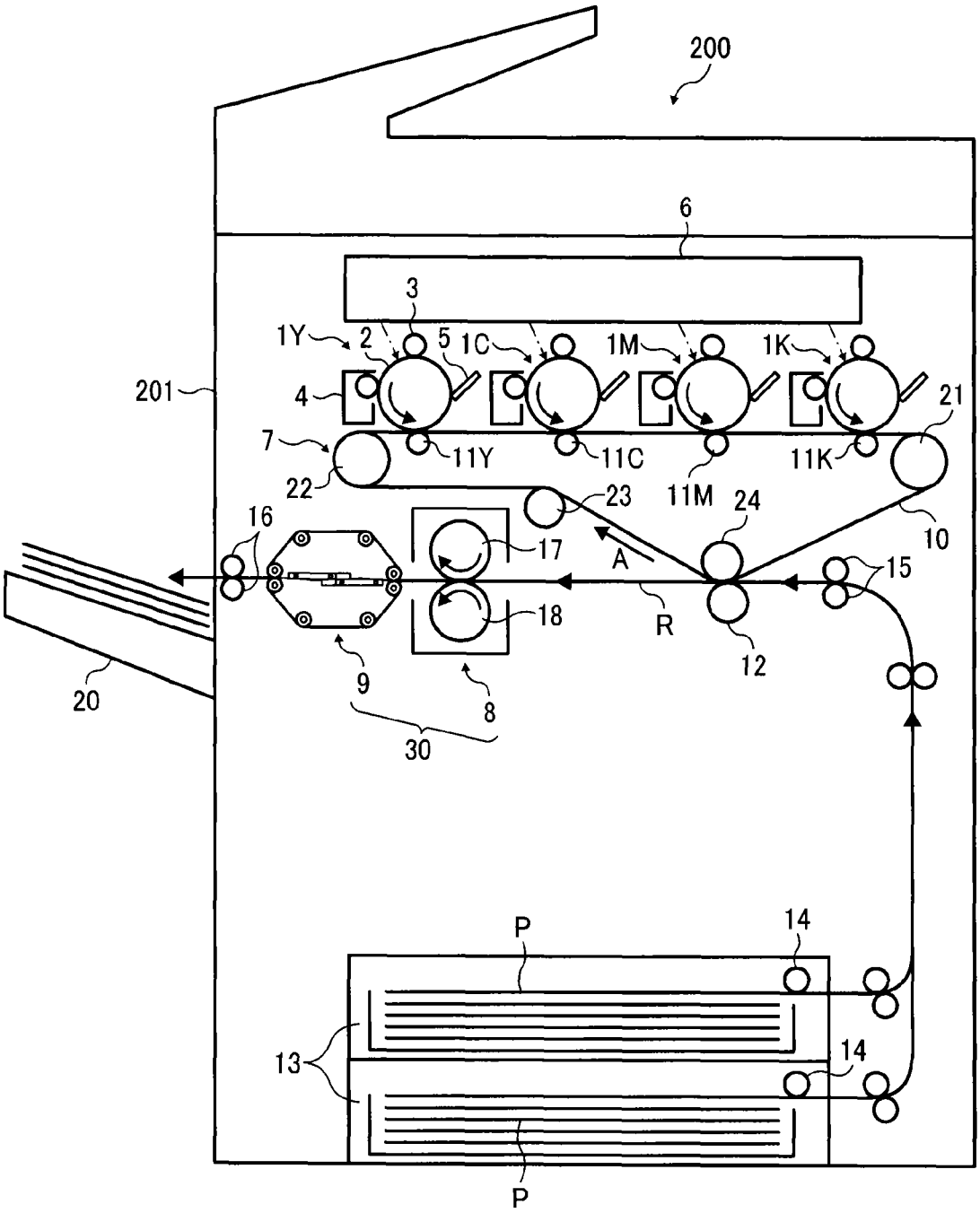
FIG. 1 is a diagram illustrating an example of a configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

FIG. 1 is a diagram illustrating a schematic configuration of an image forming apparatus 200 according to an embodiment of the present invention.

The image forming apparatus 200 may be a copier, a facsimile machine, a printer, a plotter, a multifunction peripheral or a multifunction printer (MFP) having at least one of copying, printing, scanning, facsimile, and plotter functions, or the like. According to the present embodiment, the image forming apparatus 200 is a color electrophotographic image forming apparatus that forms color and monochrome toner images on a sheet or sheets by electrophotography.

Further, it is to be noted in the following embodiments that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

The image forming apparatus 200 illustrated in FIG. 1 includes an apparatus body 201 that includes a tandem-type image forming part in which four process devices 1Y, 1C, 1M, and 1K functioning as image forming devices are aligned in tandem. The process devices 1Y, 1C, 1M, and 1K are detachably attached to the apparatus body 201 and have substantially the same configuration to each other, except for containing different color toners of yellow (Y), cyan (C), magenta (M), and black (K) corresponding to color separation components of a color image.

Specifically, each of the process devices 1Y, 1C, 1M, and 1K includes a photoconductor 2, a charging roller 3, a development device 4, and a cleaning blade 5. The photoconductor 2 is a drum-shaped photoconductor and functions as a latent image carrier. The charging roller 3 functions as a charger to uniformly charge a surface of the photoconductor 2. The development device 4 functions as a development device to form a toner image on the surface of the photoconductor 2. The cleaning blade 5 functions as a cleaning device to clean the surface of the photoconductor 2. In FIG. 1, the photoconductor 2, the charging roller 3, the development device 4, and the cleaning blade 5 are illustrated to represent the photoconductor 2Y, the charging roller 3Y, the development device 4Y, and the cleaning blade 5Y, respectively, of the process device 1Y for forming a yellow toner image. As described above, the other process devices 1C, 1M, and 1K have substantially the same configuration to the process device 1Y, and therefore the corresponding devices are included to the process devices 1C, 1M, and 1K even though illustration of these corresponding devices are omitted in FIG. 1. Hereinafter, the devices in the apparatus body 201 of the image forming apparatus 200 are also referred to in a singular form occasionally. Please note that these devices having the same reference numerals have the same structure and functions.

In FIG. 1, the image forming apparatus 200 further includes an exposure device 6, a transfer device 7, primary transfer rollers 11, and a secondary transfer roller 12 in the apparatus body 201.

The exposure device 6 is disposed above the process devices 1Y, 1C, 1M, and 1K to expose the surface of the photoconductor 2. The exposure device 6 includes a light source, polygon mirrors, f-theta (f-θ) lenses, and reflection mirrors to irradiate a laser light beam onto the surface of the photoconductor 2.

The transfer device 7 is disposed below the process devices 1Y, 1C, 1M, and 1K. The transfer device 7 includes an intermediate transfer belt 10 having a loop-shaped belt that functions as a transfer body. The intermediate transfer belt 10 is wound around multiple rollers 21 through 24 functioning as support members. One of the multiple rollers 21 through 24 rotates as a drive roller to circulate or rotate the intermediate transfer belt 10 in a direction indicated by arrow A in FIG. 1.

The primary transfer rollers 11 Y, 11 C, 11 M, and 11K are disposed facing the respective photoconductors 2. Hereinafter, the primary transfer rollers 11Y, 11C, 11M, and 11K are also referred to in a singular form as the primary transfer roller 11.

The primary transfer roller 11 that functions as a primary transfer body presses an inner circumferential surface of the intermediate transfer belt 10 at a position at which the primary transfer roller 11 faces the photoconductor 2 with the intermediate transfer belt 10 interposed therebetween. A primary transfer nip part is formed at a position where the photoconductor 2 contacts a pressed contact portion of the intermediate transfer belt 10. The primary transfer roller 11 is connected to a power source, so that a given direct current (DC) voltage and/or an alternating current (AC) voltage are supplied to the primary transfer roller 11.

The secondary transfer roller 12 that functions as a secondary transfer body is disposed facing a roller 24, which is one of the rollers around which the intermediate transfer belt 10 is wound. The secondary transfer roller 12 presses an outer circumferential surface of the intermediate transfer belt 10. A secondary transfer nip part is formed at a position where the secondary transfer roller 12 contacts a pressed contact portion of the intermediate transfer belt 10. Similar to the primary transfer roller 11, the secondary transfer roller 12 is connected to a power source, so that a given direct current (DC) voltage and/or an alternating current (AC) voltage are supplied to the secondary transfer roller 12.

The image forming apparatus 200 further includes multiple sheet trays 13 at a lower part of the apparatus body 201. The sheet trays 13 store sheets P such as papers or overhead projector (OHP) sheets. Each of the sheet trays 13 is provided with a sheet feed roller 14 to feed the sheets P accommodated therein. It is to be noted that the sheets P are also referred to in a singular form as a sheet P, specifically when details of image forming operations are described. It is also to be noted that the sheet P includes any sheet handled in the image forming apparatus 200, for example, a sheet that has not yet been conveyed and remains loaded in the sheet trays 13, a jammed sheet that causes a paper jam, and a preceding or subsequent sheet of another sheet.

The image forming apparatus 200 further includes a sheet discharging tray 20 disposed on an outer surface of the apparatus body 201 at the left side in FIG. 1. The sheet discharging tray 20 stacks the sheets P that are discharged to an outside of the apparatus body 201.

The image forming apparatus 200 further includes a sheet conveying path R in the apparatus body 201. The sheet conveying path R extends from the sheet trays 13 to the sheet discharging tray 20 via the secondary transfer nip part, so as to convey the sheet P therethrough.

A registration roller pair 15 is disposed upstream from the secondary transfer roller 12 in a sheet conveying direction in the sheet conveying path R. A fixing device 8, a cooling device 9, and a sheet discharging roller pair 16 are disposed in turn at positions downstream from the secondary transfer roller 12 in the sheet conveying direction. The fixing device 8 includes a fixing roller 17 and a pressure roller 18. The fixing roller 17 functions as a fixing member having an internal heater therein. The pressure roller 18 functions as a pressure member to press the fixing roller 17. A fixing nip part is formed at a position where the fixing roller 17 contacts the pressure roller 18. The fixing device 8 and the cooling device 9 are included in a sheet conveying device 30. Details of the sheet conveying device 30 is described below.

Next, a description is given of basic image forming operations of the image forming apparatus 200, with reference to FIG. 1.

As an image forming process starts, each of the photoconductors 2 of the process devices 1Y, 1C, 1M, and 1K is rotated counterclockwise in FIG. 1 and the charging roller 3 uniformly charges the surface of each of the photoconductors 2 to have a given polarity. Based on image data of an original document that is read by a reading device, the exposure device 6 emits the laser light beam to irradiate the charged surface of the photoconductor 2, so as to form an electrostatic latent image on the surface of the photoconductor 2. At this time, image information exposed to the photoconductor 2 is single-color image information obtained by separating a desired full-color image into single-color information on yellow, cyan, magenta, and black. Then, the development device 4 supplies toner onto the electrostatic latent image formed on the surface of the photoconductor 2, so that the electrostatic latent image on the surface of the photoconductor 2 is developed into a visible toner image.

One of the rollers 21 through 24 around which the intermediate transfer belt 10 is wound is driven to rotate to circulate the intermediate transfer belt 10 in the direction A in FIG. 1. Further, a voltage having a polarity opposite a charged polarity of toner and subjected to constant voltage or current control is supplied to the primary transfer roller 11. Consequently, a transfer electric field is generated in the primary transfer nip part between the primary transfer rollers 11 and the photoconductor 2. Each single toner image formed on the surface of the photoconductor 2 is sequentially transferred onto an outer surface of the intermediate transfer belt 10 by action of the transfer electric field in the primary transfer nip part. Thus, the intermediate transfer belt 10 carries a full-color toner image on the surface of the intermediate transfer belt 10.

Residual toner remaining on the surface of the photoconductor 2 without being transferred onto the surface of the intermediate transfer belt 10 is removed by the cleaning blade 5.

Along with rotation of the sheet feed roller 14, the sheet P is fed from a selected one of the sheet trays 13. The sheet P fed from the sheet tray 13 is further conveyed to the secondary transfer nip part between the secondary transfer roller 12 and the intermediate transfer belt 10 in synchronization with movement of the sheet P with the registration roller pair 15. At this time, a transfer voltage of the polarity opposite the charged polarity of toner of the toner image formed on the intermediate transfer belt 10 is supplied to the secondary transfer roller 12, so that a transfer electric field is generated in the secondary transfer nip part. By action of the transfer electric field generated in the secondary transfer nip part, the toner image formed on the surface of the intermediate transfer belt 10 is transferred onto the sheet P. Thereafter, the sheet P is conveyed to the fixing device 8, where the toner image on the sheet P is fixed to the sheet P by application of heat and pressure by the fixing roller 17 and the pressure roller 18. The sheet P is then cooled by the cooling device 9, and is finally discharged to the sheet discharging tray 20 by the sheet discharging roller pair 16 that functions as a sheet discharging part to discharge the sheet P to an outside of the apparatus body 201.

The above-described operations are performed when a full-color image is formed on the sheet P. Other than the above-described operations, any one of the process devices 1Y, 1C, 1M, and 1K can selectively be used for forming a single color image or any two or three of the process devices 1Y, 1C, 1M, and 1K can be used for forming a composite image of two or three colors.

Figure 2:
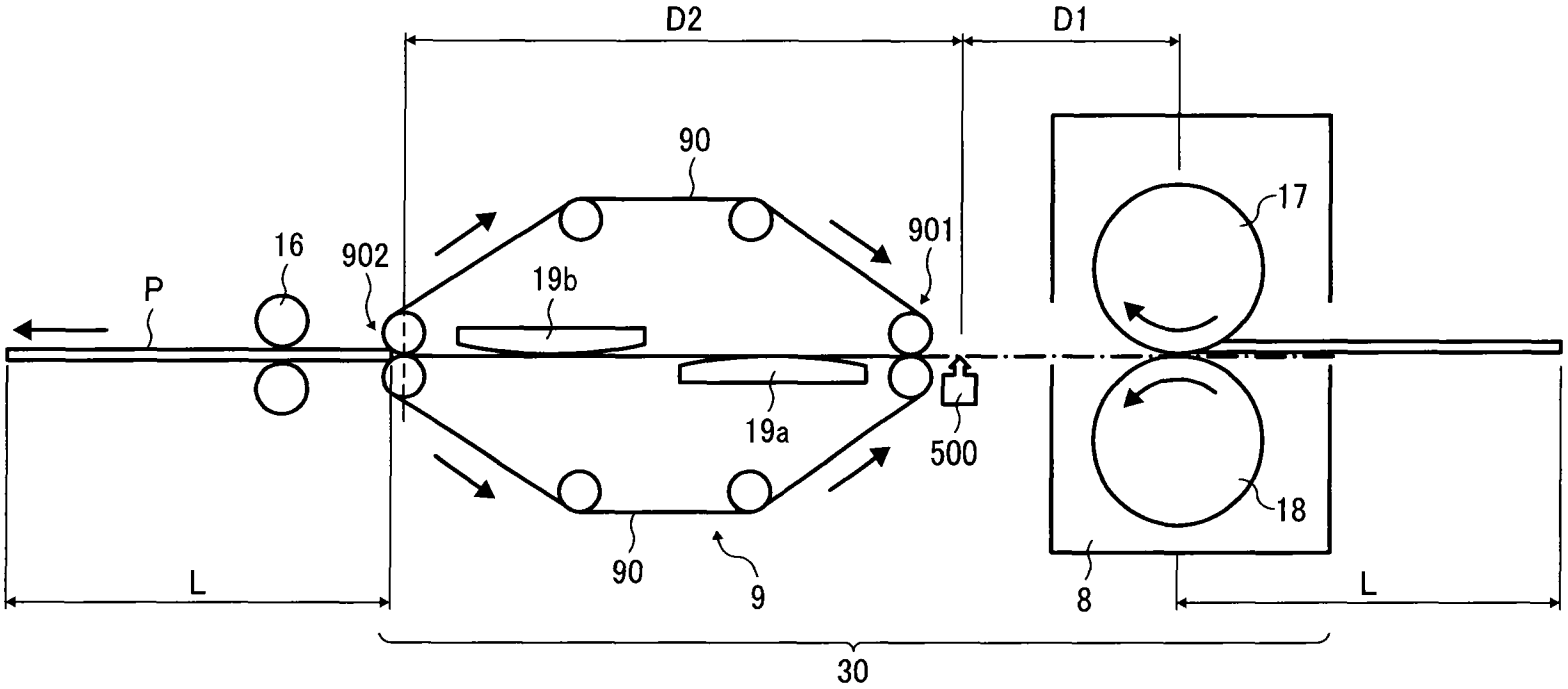
FIG. 2 is a diagram illustrating an example of a configuration of a sheet conveying device according to an embodiment of the present invention.

Next, a description is given of an example of a configuration of the sheet conveying device 30, with reference to FIG. 2.

As previously described, the sheet conveying device 30 includes the fixing device 8 and the cooling device 9. The cooling device 9 includes a pair of holding/conveying belts 90, heat exchanging bodies (cooling bodies) 19*a* and 19*b*, and a holding/conveying belt driving device 91 (refer to FIG. 17). The pair of holding/conveying belts 90 of the cooling device 9 includes two belts disposed vertically on a downstream side of the fixing device 8 in the sheet conveying direction. Each of the pair of holding/conveying belts 90 is wound around multiple rollers, respectively. The heat exchanging bodies 19*a* and 19*b* function as cooling bodies fixedly disposed in contact with respective inner circumferential surfaces of the pair of holding/conveying belts 90. The holding/conveying belt driving device 91 drives the pair of holding/conveying belts 90. Areas on the pair of holding/conveying belts 90 adjacent to the heat exchanging bodies 19*a* and 19*b* are cooled and maintained at a low temperature.

The pair of holding/conveying belts 90 that functions as a holding/conveying belt device has an entrance roller pair 901 and an exit roller pair 902. Specifically, the entrance roller pair 901 that functions as an entrance part is disposed on an upstream side of the pair of holding/conveying belts 90 in the sheet conveying direction, so that the sheet P enters between the pair of holding/conveying belts 90. The exit roller pair 902 that functions as an exit part is disposed on a downstream side of the pair of holding/conveying belts 90 in the sheet conveying direction, so that the sheet P is discharged from the pair of holding/conveying belts 90. A sensor 500 is included in the sheet conveying device 30 and is disposed between the fixing device 8 and the cooling device 9, specifically at the entrance roller pair 901 of the cooling device 9. The sensor 500 functions as a first sheet detector to detect whether or not the sheet P is at the sensor 500. Due to the pair of holding/conveying belts 90 being two belts, the sensor 500 cannot be disposed inside the respective loops of the pair of holding/conveying belts 90.

The sheet P has a length L in the sheet conveying direction.

Hereinafter, a state in which the sensor 500 detects the sheet P is referred to as a "sensor ON" or a "sensor ON state" and a state in which the sensor 500 does not detect the sheet P is referred to as a "sensor OFF" or a "sensor OFF state". The sensor ON state includes a state in which the sheet P is in the cooling device 9 and the sensor 500 has detected a trailing edge of the sheet P and a state in which the sheet P is in the fixing device 8 and the sensor 500 has detected a leading edge of the sheet P. That is, it is not determined that the sheet P is constantly held between the pair of holding/conveying belts 90 in the sensor ON state. However, in the sensor ON state, it is recognized that the sheet P is at the sensor 500.

Since the pair of holding/conveying belts 90 includes two belts to hold and convey the sheet P, a paper jam does not occur often when the sheet P is conveyed in the pair of holding/conveying belts 90. Specifically, the paper jam can occur anywhere in the sheet conveying path R in the image forming apparatus 200 other than the cooling device 9. Further, even when the sheet P becomes jammed in the pair of holding/conveying belts 90, the sheet P can be forcedly discharged with rotation of the pair of holding/conveying belts 90. A significantly crumpled sheet P can be eventually discharged from an exit roller of the pair holding/conveying belts 90. The discharge of the jammed sheet P can prevent the non-jammed sheet P from being stagnated or being left unattended in the pair of holding/conveying belts 90. In the sensor ON state, the sheet P detected by the sensor 500 can be jammed or not. However, the sheet P can be discharged from the pair of holding/conveying belts 90 without determining whether the sheet P is jammed or not.

Next, a description is given of operations of controlling the sheet conveying device 30 when the paper jam occurs, with reference to FIGS. 3 through 9.

Figure 3:
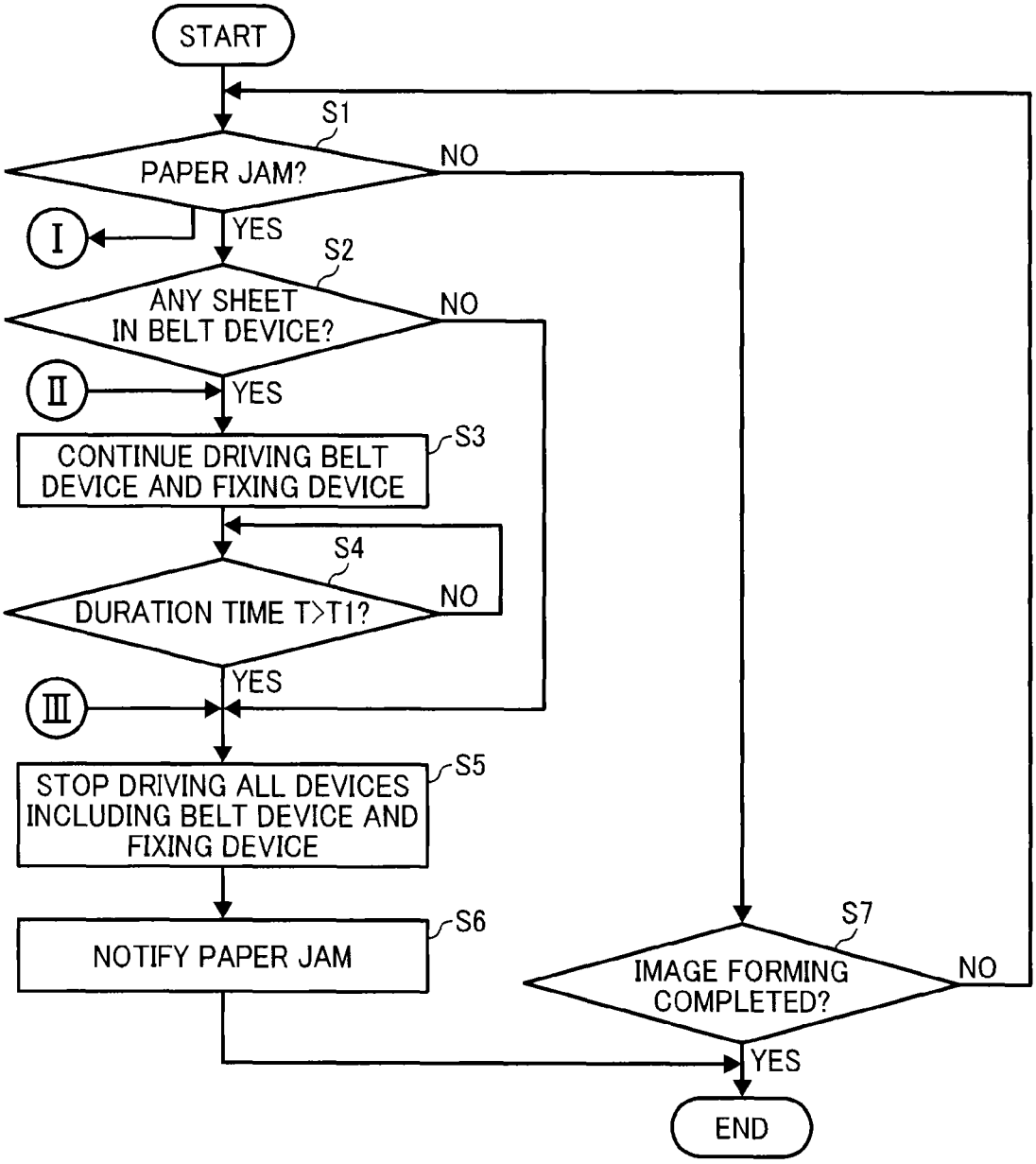
FIG. 3 is a diagram illustrating of a control flow of the sheet conveying device when a paper jam occurs.

FIG. 3 illustrates a series of basic operations of a control flow of the sheet conveying device 30 when the paper jam occurs.

The image forming apparatus 200 further includes a controller 2000 (refer to FIG. 17) to control processes of steps in each control flow and determine based on each detection result.

As a series of image forming operations starts in the image forming apparatus 200, a series of image forming operations continues until the paper jam occurs.

While no paper jam occurs (NO in step Si), the series of image forming operations continues and the sheet conveying device 30 conveys the sheet P to be discharged to the sheet discharging tray 20. Specifically, when the series of image forming operations is not completed (NO in step S7), the above-described processes of step S1 and S7 are performed repeatedly. After completion of the whole series of image forming operations (YES in step S7) and completion of discharge of the sheet P properly, the image forming operation ends.

By contrast, when the controller 2000 determines that the paper jam occurs anywhere in the sheet conveying path R in the image forming apparatus 200 during the image forming operation (YES in step S1), the image forming apparatus 200 stops the whole conveyance driving operations performed on the upstream side from a paper jam point or a point where the paper jam has occurred, so as to prevent entry of the sheet P to the fixing device 8 and the cooling device 9. Then, the image forming apparatus 200 causes a sheet detector to detect whether or not the sheet P under conveyance exists in the pair of holding/conveying belts 90 (step S2). As a method of detecting the sheet P in the pair of holding/conveying belts 90, the sensor 500 can be employed as illustrated in FIG. 2 and/or a detector to detect unevenness on the respective inner circumferential surfaces of the pair of holding/conveying belts 90. It is to be noted that, even though the present embodiment employs the sensor 500 as a sheet detector, however, the sheet detector is not limited thereto.

When the sheet detector (i.e., the sensor 500) detects that there is no sheet in the pair of holding/conveying belts 90 (NO in step S2), the driving of the pair of holding/conveying belts 90, the fixing roller 17, the pressure roller 18, and related devices and components for conveying the sheet P from the pair of holding/conveying belts 90 is stopped immediately (step S5). This process is taken because no sheet P to be discharged is left in the pair of holding/conveying belts 90. In addition, this process of stopping the driving of the devices and components prevents entry of the subsequent sheet(s) P into the fixing device 8 and the cooling device 9. There may be a case in which the sheet P is left in the fixing device 8. However, this case can be accepted unless the sheet P exists in the pair of holding/conveying belts 90.

Hereinafter, the term "the related devices and components" is referred to as "the related devices" for simplicity.

By contrast, when the sheet detector (i.e., the sensor 500) detects that there is the sheet P in the pair of holding/conveying belts 90 (YES in step S2), the pair of holding/conveying belts 90, the fixing roller 17, the pressure roller 18, and the related devices for conveying the sheet P from the pair of holding/conveying belts 90 continue driving these devices for a given first conveying time T1 (step S3).

Here, the first conveying time T1 is obtained by the following expression:

$$T1=(D1+D2+L)/V,$$

where "V" represents a sheet conveying speed, "L" represents a length of the sheet P in the sheet conveying direction, "D1" represents a distance from a fixing nip part formed between the fixing roller 17 and the pressure roller 18 to the sensor 500, and "D2" represents a distance from the sensor 500 to a nip part of the exit roller pair 902 of the cooling device 9, as illustrated in FIG. 2.

The exit roller pair 902 are rollers around which the pair of holding/conveying belts 90 are wound. The length L can also be applied to a length that has been set for the image forming operation or a length of the sheet P automatically detected in the sheet tray 13.

The first conveying time T1 corresponds to a time during which the sheet P being conveyed in FIG. 2 passes by the fixing roller 17 and goes through the pair of holding/conveying belts 90 completely. The first conveying time T1 is a longest time for performing the process.

As described above, the sensor ON state includes a state in which the sheet P is left in the fixing device 8 and is not in the cooling device 9. Therefore, by continuing the driving of the devices for the first conveying time T1, at least the sheet P is discharged from the cooling device 9.

In addition to prevention of entry of the sheet P to the cooling device, the reason for stopping the whole devices after the first conveying time T1 has elapsed is to prevent the paper jam from secondarily occurring in the sheet conveying path R. For example, in the event of the paper jam in the sheet conveying path R on the downstream side from the cooling device 9, if these devices continue driving to discharge the jammed sheet P to the sheet discharging tray 20, the paper jam secondarily can occur in the sheet conveying path R.

Further, an alternative or additional sensor can be provided at an entrance part of the fixing device 8 and/or the exit roller pair 902 of the cooling device 9 in the sheet conveying path R illustrated in FIG. 1.

Some other methods other than the simple method using the sensor 500 to check the sensor ON/OFF state can be employed to detect whether or not the sheet P is in the pair of holding/conveying belts 90. For example, the present embodiment can employ a method of measuring a time elapsed from when the trailing edge of the sheet P is out of the sensor 500 (the sensor 500 turns off), a method of determining the existence of the sheet P by detecting that the sheet P out of the sensor 500 (the sensor 500 turns off) is left at a sensor disposed at the exit part of the cooling device 9, and so forth.

Existence of the sheet P may be determined by detecting the sensor ON state of the sensor 500 and an additional sensor (for example, a sensor 510, which is described below). Details of this sheet conveying operation are described later with reference to FIGS. 10 through 12.

When a driving operation duration time T is equal to or smaller than the first conveying time T1 (T≤T1) (NO in step S4), the process is performed repeatedly until the driving operation duration time T turns greater than the first conveying time T1 (T>T1).

When the driving operation duration time T turns greater than the first conveying time T1 (T>T1) (YES in step S4), the driving of the whole driving devices including the pair of holding/conveying belts 90, the fixing roller 17, and the pressure roller 18 is stopped (step S5). Then, the paper jam is notified to users via a notification part 92 (see FIG. 17) (step S6), and the series of image forming operations ends. The notification part 92 notifies the users of the paper jam by at least one of a text message, sound, attention light and the like.

Figure 4:
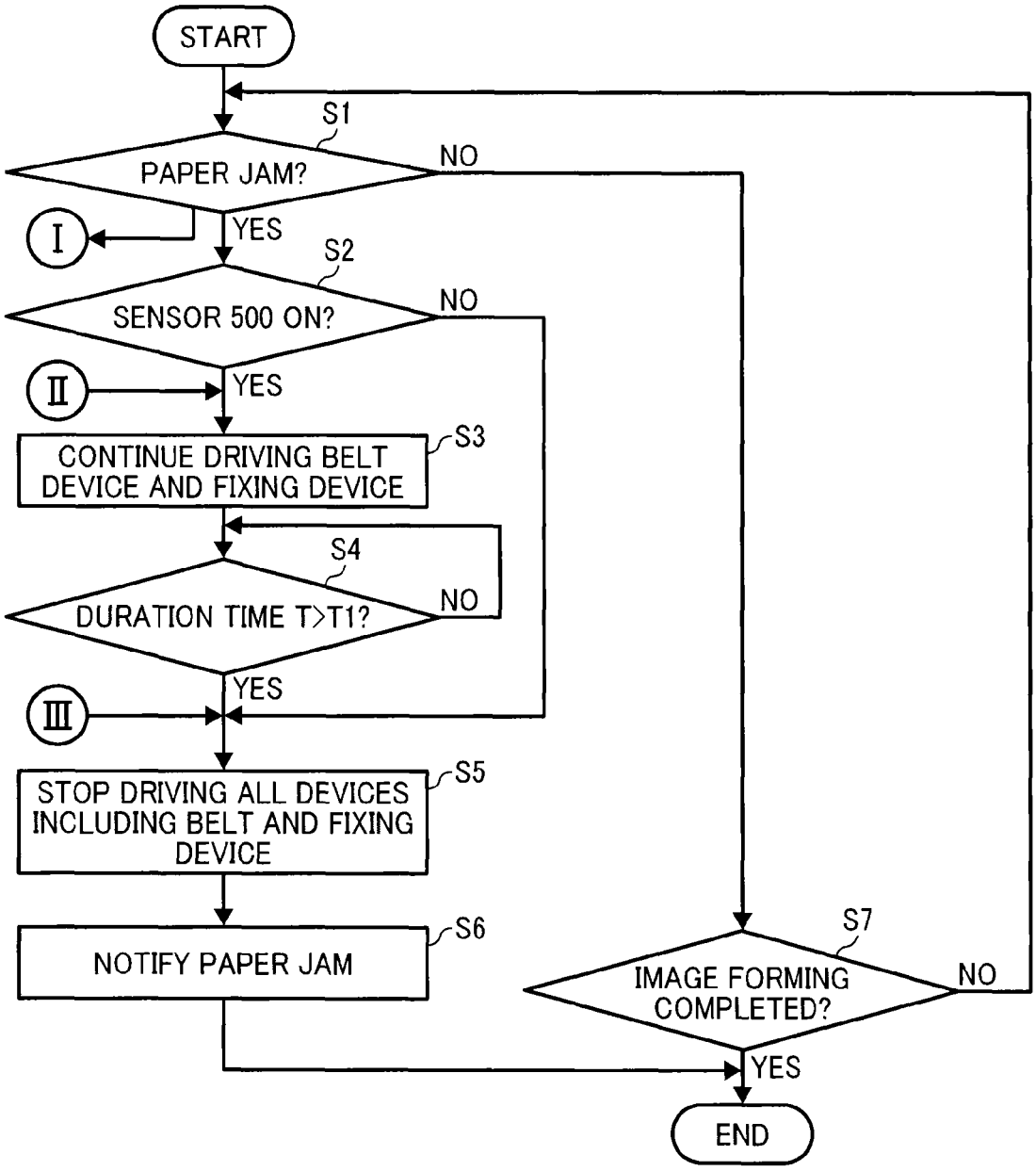
FIG. 4 is a diagram illustrating a control flow of the sheet conveying device as another example of the control flow of FIG. 3.

FIG. 4 is a diagram illustrating another control flow of the sheet conveying device 30 as another example of the control flow of FIG. 3.

In this control flow illustrated in FIG. 4, the sensor 500 illustrated in FIG. 2 functions as a sheet detector to detect the sheet P in the pair of holding/conveying belts 90 in step S2 of the control flow of FIG. 3.

While no paper jam occurs (NO in step S1), the series of image forming operations continues and the sheet conveying device 30 conveys the sheet P to be discharged to the sheet discharging tray 20. Specifically, when the series of image forming operations is not completed (NO in step S7), the above-described processes of step Si and S7 are performed repeatedly. After completion of the whole series of image forming operations (YES in step S7) and completion of discharge of the sheet P properly, the image forming operation ends.

When the controller 2000 determines occurrence of the paper jam based on a detection result whether the sensors, which include the sensor 500 and are disposed in the sheet conveying path R, detect the sheet ON state or the sheet OFF state anywhere in the sheet conveying path R in the image forming apparatus 200 in the image forming operation (YES in step S1), in a case in which the sensor 500 does not detect the sheet P, which is in the sensor OFF state (NO in step S2), driving of the pair of holding/conveying belts 90, the fixing roller 17, and the related devices for conveying the sheet P from the pair of holding/conveying belts 90 is stopped immediately (step S5).

By contrast, when the sensors including the sensor 500 detect that the sensor 500 detects the sheet P, which is in the sensor ON state (YES in step S2), the pair of holding/conveying belts 90, the fixing roller 17, and the related devices for conveying the sheet P from the pair of holding/conveying belts 90 continue driving these devices for the first conveying time T1 (step S3).

When the driving operation duration time T is equal to or smaller than the first conveying time T1 (T≤T1) (NO in step S4), the process is performed repeatedly until the driving operation duration time T turns greater than the first conveying time T1 (T>T1).

When the driving operation duration time T turns greater than the first conveying time T1 (T>T1) (YES in step S4), the driving of the whole driving devices including the pair of holding/conveying belts 90 and the fixing roller 17 is stopped (step S5). Then, the paper jam is notified to the users via the notification part 92 (step S6), and the series of image forming operations ends.

Figure 5:
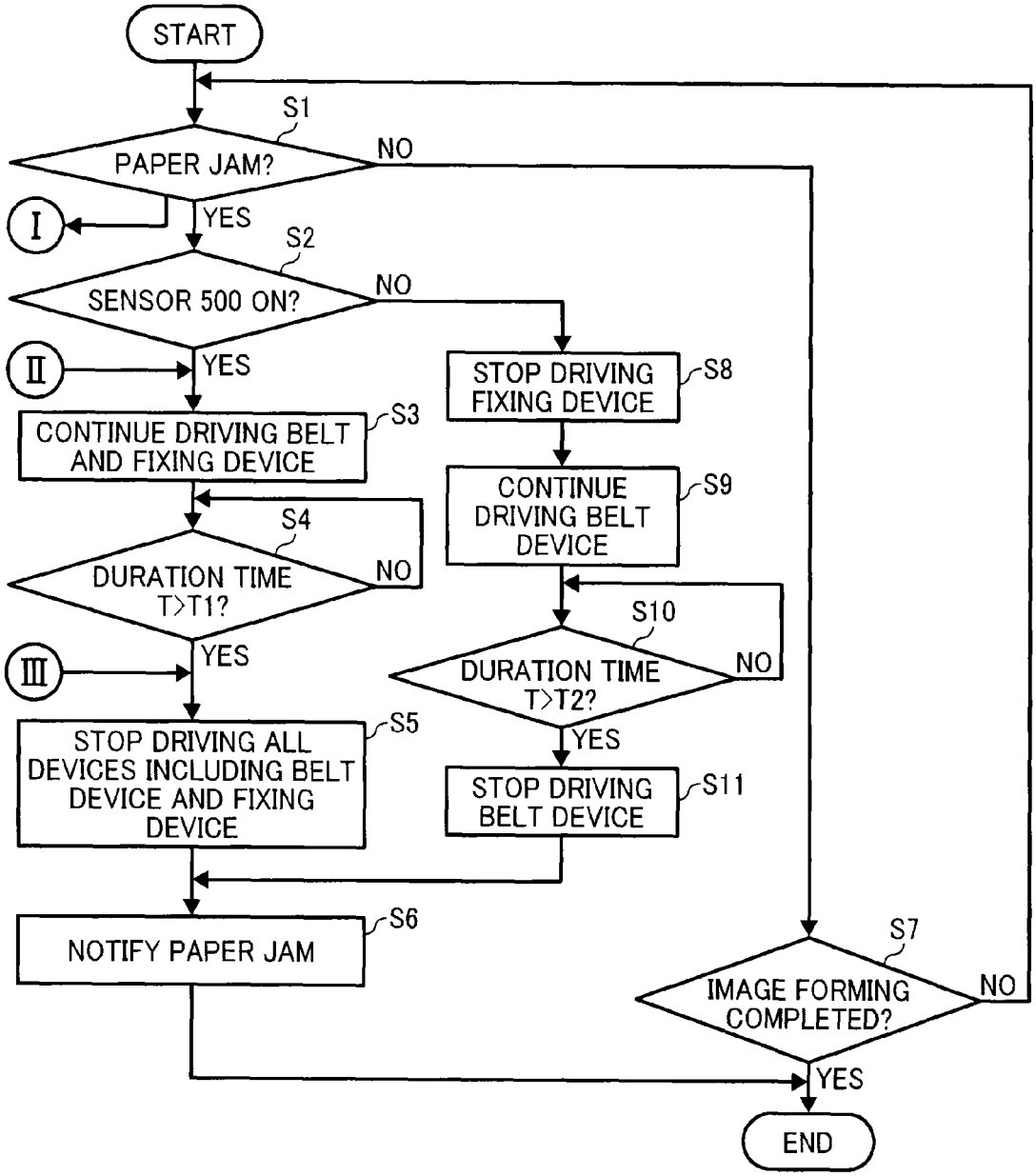
FIG. 5 is a diagram illustrating a control flow of the sheet conveying device as another example of the control flow of FIG. 4.

FIG. 5 is a diagram illustrating another control flow of the sheet conveying device 30 as another example of the control flow of FIG. 4.

In this control flow illustrated in FIG. 5, the sensor 500 illustrated in FIG. 2 functions as a sheet detector to detect the sheet P in the pair of holding/conveying belts 90 in step S2 of the control flow of FIG. 3.

In this control flow illustrated in FIG. 5, when the sensor 500 detects the sheet P, which is in the sensor OFF state in the event of the paper jam (NO in step S2), the fixing device 8 is stopped driving (step S8), and then the pair of holding/conveying belts 90 is stopped after being driven for a given time (steps S9 through S11). Stopping the fixing device 8 prior to the pair of holding/conveying belts 90 can prevent entry of the sheet P into the pair of holding/conveying belts 90 and, at the same time, occurrence of a secondary paper jam caused by the sheet P approaching the fixing device 8 and damage to the fixing device 8 due to the secondary paper jam.

Specifically, while no paper jam occurs (NO in step 51), the series of image forming operations continues and the sheet conveying device 30 conveys the sheet P to be discharged to the sheet discharging tray 20. Specifically, when the series of image forming operations is not completed (NO in step S7), the above-described processes of step S1 and S7 are performed repeatedly. After completion of the whole series of image forming operations (YES in step S7) and completion of proper discharging of the sheet P, the image forming operation ends.

When the controller 2000 determines occurrence of the paper jam anywhere in the sheet conveying path R in the image forming apparatus 200 in the image forming operation based on a detection result whether the sensor 500 detects the sheet ON state or the sheet OFF state (YES in step S1), in a case in which the sensor 500 is in the sensor OFF state in the event of the paper jam (NO in step S2), the driving of the fixing device 8 is stopped immediately (step S8). Then, without detection of existence of the sheet P in the pair of holding/conveying belts 90, the pair of holding/conveying belts 90 continues driving for a second conveying time T2 (step S9).

Here, the second conveying time T2 is obtained by the following expression:

$$T2=(D2+L)/V,$$

where the second conveying time T2 corresponds to a minimum time during which the sheet P being conveyed in FIG. 2 passes through the pair of holding/conveying belts 90 completely.

When the driving operation duration time T is equal to or smaller than the second conveying time T2 (T>T2) (NO in step S10), the process is performed repeatedly until the driving operation duration time T turns greater than the second conveying time T2 (T>T2).

When the driving operation duration time T turns greater than the second conveying time T2 (T>T2) (YES in step S10), the driving of the pair of holding/conveying belts 90 is stopped (step S11). Then, the paper jam is notified to the users via the notification part 92 (step S6), and the series of image forming operations ends.

Same as the control flow illustrated in FIG. 4, when the sensors including the sensor 500 detect that the sensor 500 turns on, which is in the sensor ON state (YES in step S2), the pair of holding/conveying belts 90, the fixing roller 17, and the related devices for conveying the sheet P from the pair of holding/conveying belts 90 continue driving these devices for the first conveying time T1 (step S3). When the driving operation duration time T is equal to or smaller than the first conveying time T1 (T≤T1) (NO in step S4), the process is performed repeatedly until the driving operation duration time T turns greater than the first conveying time T1 (T>T1).

When the driving operation duration time T turns greater than the first conveying time T1 (T>T1) (YES in step S4), the driving of the whole driving devices including the pair of holding/conveying belts 90 and the fixing roller 17 is stopped (step S5). Then, the paper jam is notified to the users via the notification part 92 (step S6), and the series of image forming operations ends.

Figure 6:
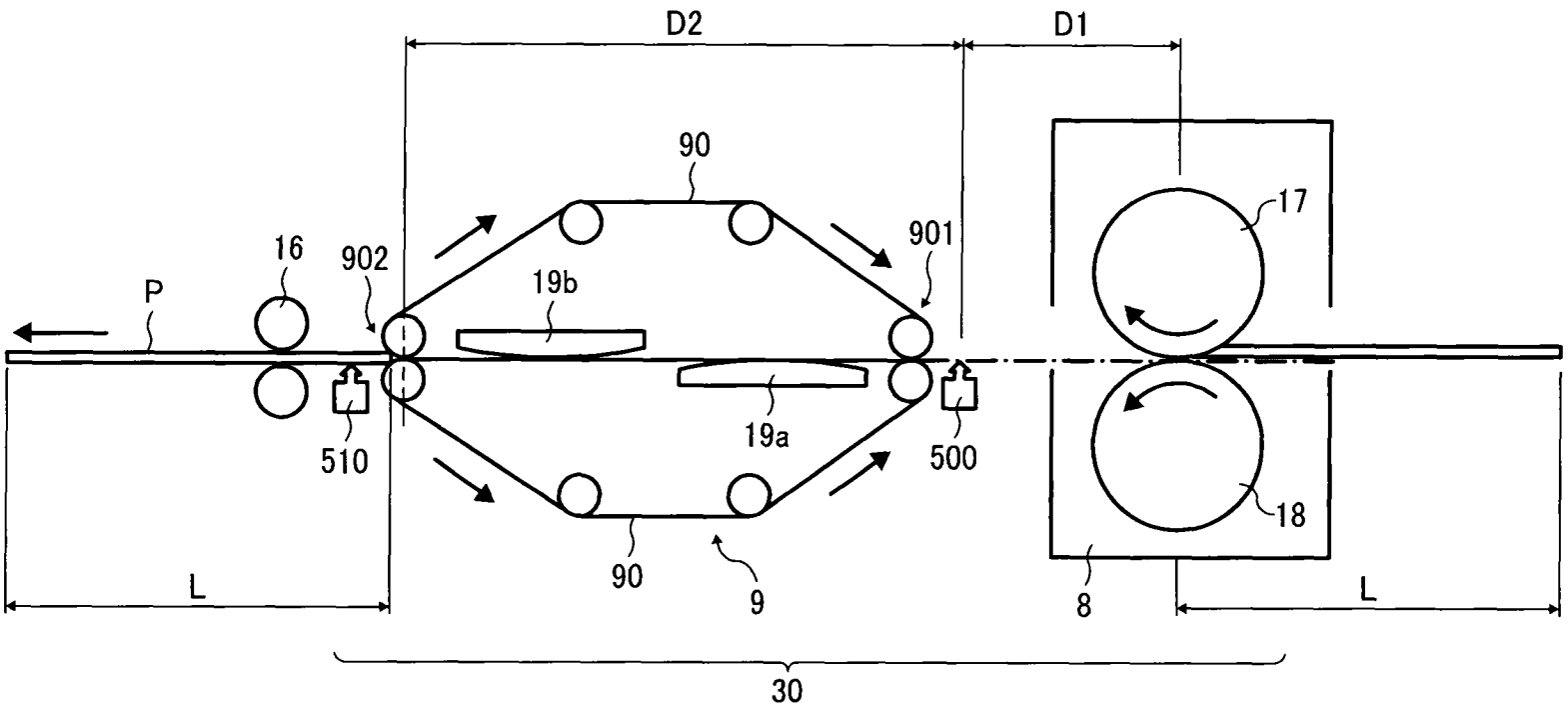
FIG. 6 is a diagram illustrating another example of a configuration of the sheet conveying device according to the embodiment.

FIG. 6 is a diagram illustrating another example of a configuration of the sheet conveying device 30 according to the above-described embodiment.

The elements or components of the sheet conveying device 30 illustrated in FIG. 6 are basically identical in structure and functions to the elements or components of the sheet conveying device 30 illustrated in FIG. 2, except that the sheet conveying device 30 illustrated in FIG. 6 further includes the sensor 510 that functions as a second sheet detector to detect whether the sheet P is still in the pair of holding/conveying belts 90.

Figure 7:
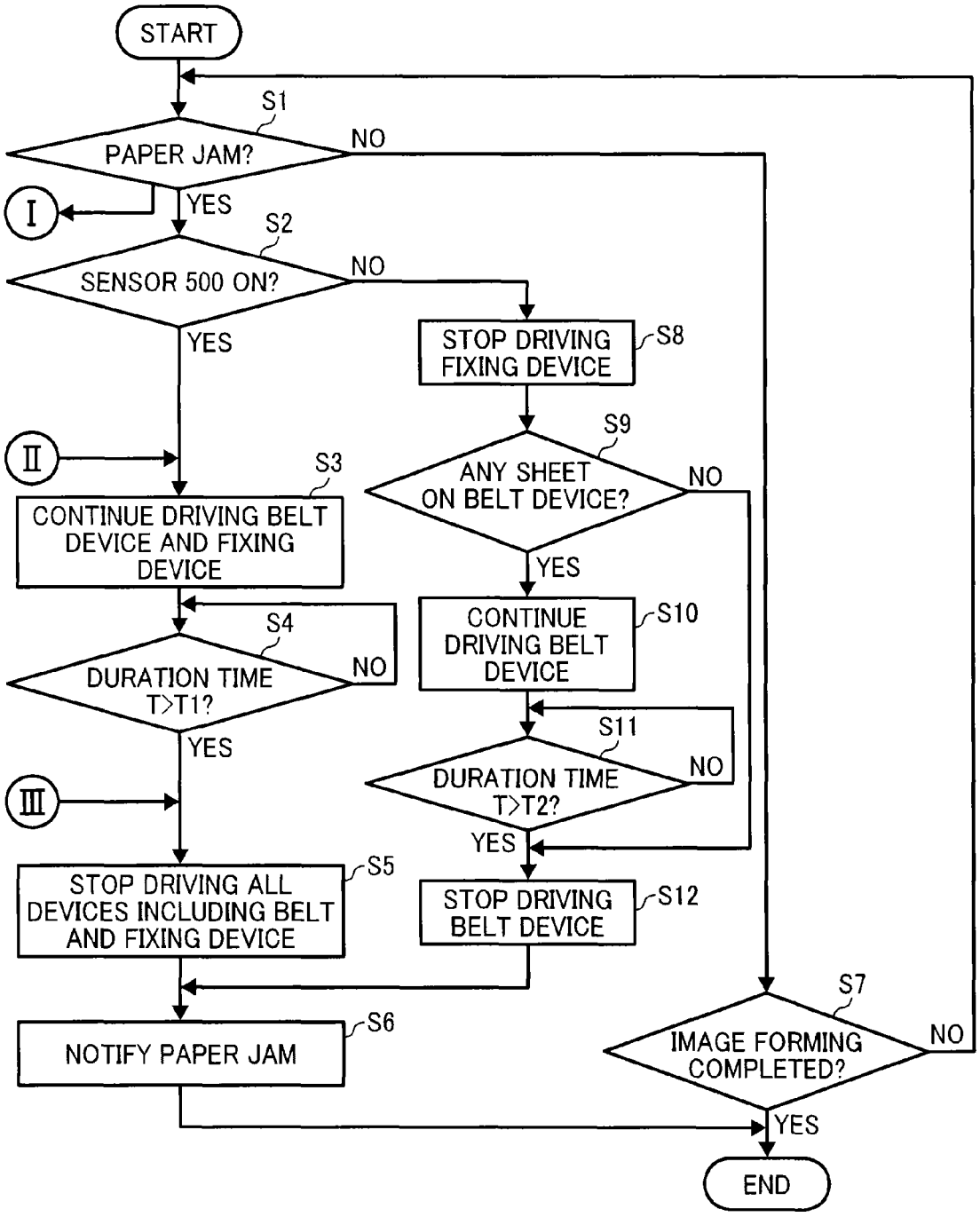
FIG. 7 is a diagram illustrating a control flow of the sheet conveying device as another example of the control flow of FIG. 5.

FIG. 7 is a diagram illustrating another control flow of the sheet conveying device 30 of FIG. 6 as another example of the control flow of FIG. 5.

In this control flow illustrated in FIG. 7, the sensors 500 and 510 illustrated in FIG. 6 function as sheet detectors to detect the sheet P in the control flow of FIG. 3.

In this control flow illustrated in FIG. 7, the sensor 510 is disposed at the exit roller pair 902 in addition to the sensor 500 as illustrated in FIG. 6. The sensor 500 functions as a first sheet detector and the sensor 510 functions as a second sheet detector to detect whether or not the sheet P is in the pair of holding/conveying belts 90. Further, immediately before the paper jam, when a time that elapses from which the sheet P passes by the sensor 500 (i.e., a time during the sensor 500 is in the sensor OFF state) is within a given time, it is determined that the sheet P exists in the pair of holding/conveying belts 90, and when the time exceed the given time, it is determined that there is no sheet left in the pair of holding/conveying belts 90.

In this control flow illustrated in FIG. 7, while no paper jam occurs (NO in step S1), the series of the image forming operations continues and the sheet conveying device 30 conveys the sheet P to be discharged to the sheet discharging tray 20. After completion of the whole series of the image forming operations (YES in step S7) and completion of proper discharging of the sheet P, the image forming operation ends. When the series of the image forming operations is not completed (NO in step S7), the above-described processes of step S1 and S7 are performed repeatedly.

When the controller 2000 determines occurrence of the paper jam anywhere in the sheet conveying path R in the image forming apparatus 200 in the image forming operation based on the detection result whether the sensor 500 detects the sheet ON state or the sheet OFF state (YES in step S1), in a case in which the sensor 500 is in the sensor OFF state in the event of the paper jam (NO in step S2), the driving of the fixing device 8 is stopped immediately (step S8). Then, whether or not there is the sheet P being conveyed in the pair of holding/conveying belts 90 is determined (step S9). As described above, existence of the sheet P is detected based on the sensor 500 or the elapsed time since the sensor 510 turns on. For example, when the elapsed time before the paper jam occurs and after the sheet P has passed by the sensor 500 is longer than a given time (a time during which the sheet P passes through the pair of holding/conveying belts 90) and there is no sheet left in the pair of holding/conveying belts 90 (NO in step S9), the driving of the pair of holding/conveying belts 90 is immediately stopped (step S12). While the pair of holding/conveying belts 90 continues driving for the given conveying time (i.e., the second conveying time T2) in the control flow of FIG. 5, whether or not there is the sheet P left in the pair of holding/conveying belts 90 is determined in the control flow of FIG. 7. By so doing, the pair of holding/conveying belts 90 does not continue driving unnecessarily.

By contrast, for example, when the elapsed time before the paper jam occurs and after the sheet P has passed by the sensor 500 is within the given time and there is the sheet P left in the pair of holding/conveying belts 90 (YES in step S9), the pair of holding/conveying belts 90 continues driving for the second conveying time T2 (step S 10).

When the driving operation duration time T is equal to or smaller than the second conveying time T2 (T≤T2) (NO in step S 11), the process is performed repeatedly until the driving operation duration time T turns greater than the second conveying time T2 (T>T2).

When the driving operation duration time T turns greater than the second conveying time T2 (T>T2) (YES in step S11), the driving of the pair of holding/conveying belts 90 is stopped (step S12). Then, the paper jam is notified to the users via the notification part 92 (step S6), and the series of image forming operations ends.

Same as the control flow illustrated in FIG. 5, when the sensors including the sensor 500 detect that the sensor 500 is in the sensor ON state (YES in step S2), the pair of holding/conveying belts 90, the fixing roller 17, and the related devices for conveying the sheet P from the pair of holding/conveying belts 90 continue driving these devices for the first conveying time T1 (step S3).

When the driving operation duration time T is equal to or smaller than the first conveying time T1 (T≤T1) (NO in step S4), the process is performed repeatedly until the driving operation duration time T turns greater than the first conveying time T1 (T>T1). When the driving operation duration time T turns greater than the first conveying time T1 (T>T1) (YES in step S4), driving of the whole driving devices including the pair of holding/conveying belts 90 and the fixing roller 17 is stopped (step S5). Then, the paper jam is notified to the users via the notification part 92 (step S6), and the series of image forming operations ends.

Figure 8:
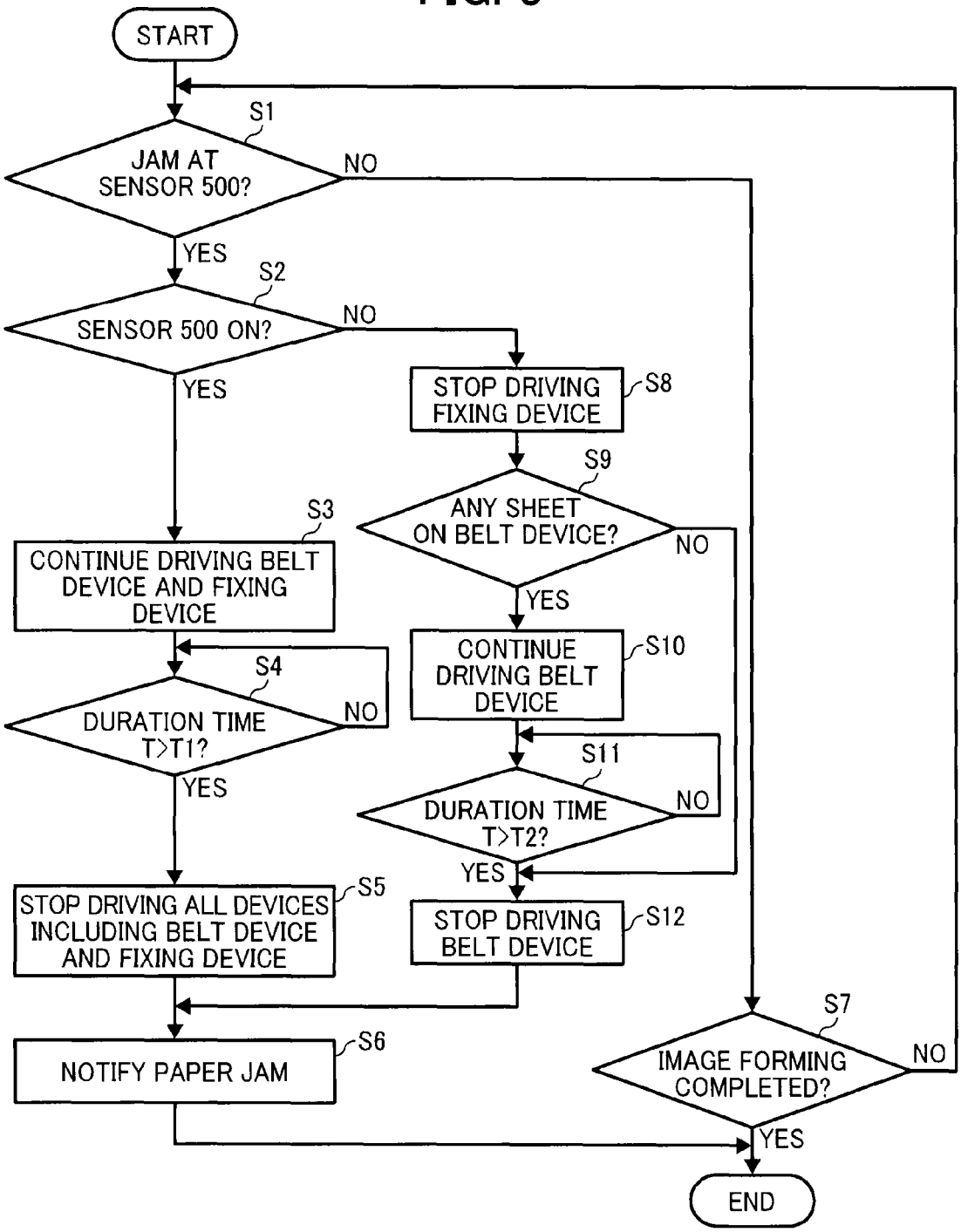
FIG. 8 is a diagram illustrating a control flow of the sheet conveying device as another example of the control flow of FIG. 7.

FIG. 8 is a diagram illustrating another control flow of the sheet conveying device 30 as another example of the control flow of FIG. 7.

While FIG. 7 illustrates the flowchart of the control flow when the sensors including the sensor 500 in the sheet conveying path R detect the paper jam anywhere in the sheet conveying path R in the image forming apparatus 200 in the image forming operation, FIG. 8 illustrates a flowchart of the control flow when the controller 2000 determines occurrence of the paper jam based on the detection result of the sensor 500 in the series of image forming operations.

First, a description is given of a control flow by which the paper jam is determined based on the detection result obtained by the sensor 500.

For example, a sensor 520 (refer to FIG. 17) is disposed at an adequate position corresponding to the fixing device 8. When the sensor 520 that functions as a third sheet detector turns on by the leading edge of the sheet P and turns off by the trailing edge of the sheet P, the sensor 500 that is disposed downstream from the sensor 520 in the sheet conveying direction turns on by the leading edge of the sheet P within a given time and turns off by the trailing edge of the sheet P. However, when the sensor 500 does not turn on within the given time, the controller 2000 determines that the sheet P exists between the sensor 520 and the sensor 500, which is an expected paper jam to the cooling device 9. Further, when the sensor 500 turns on within the given time and does not turn within the given time, the controller 2000 determines that the sheet P is left in the pair of holding/conveying belts 90, which is a substantial paper jam to the cooling device 9. Thus, whether or not the sensor 500 detects the sheet P within the given times can determine occurrence of the paper jam.

It is to be noted that the sensor 520 is a single sensor in the above-described example. However, two or more sensors 520 can also be applied to the example of the present embodiment.

When the controller 2000 does not determine the paper jam based on the detection result of the sensor 500 in the image forming operation while the paper jam is occurring (NO in step S1), the series of the image forming operations continues and the sheet conveying device 30 conveys the sheet P so as to discharge the sheet P to the sheet discharging tray 20. Specifically, when the series of the image forming operations is not completed (NO in step S7), the above-described processes of steps S1 and S7 are performed repeatedly. After completion of the whole series of the image forming operations (YES in step S7) and completion of proper discharging of the sheet P, the image forming operation ends.

When the controller 2000 determines the paper jam based on the detection result of the sensor 500 in the image forming operation (YES in step S1), the controller 2000 determines whether or not the sensor 500 turns on in step S2.

When the sensor 500 does not turn on (NO in step S2), the processes of steps S8 through S12, which are the same processes of steps S8 through S12 in FIG. 7, are taken, then the paper jam is notified to the users via the notification part 92 (step S6), and the series of image forming operations ends.

When the sensor 500 turns on (YES in step S2), the processes of steps S3 through S5, which are the same processes of steps S3 through S5 in FIG. 7, are taken, then the paper jam is notified to the users via the notification part 92 (step S6), and the series of image forming operations ends.

Figure 9:
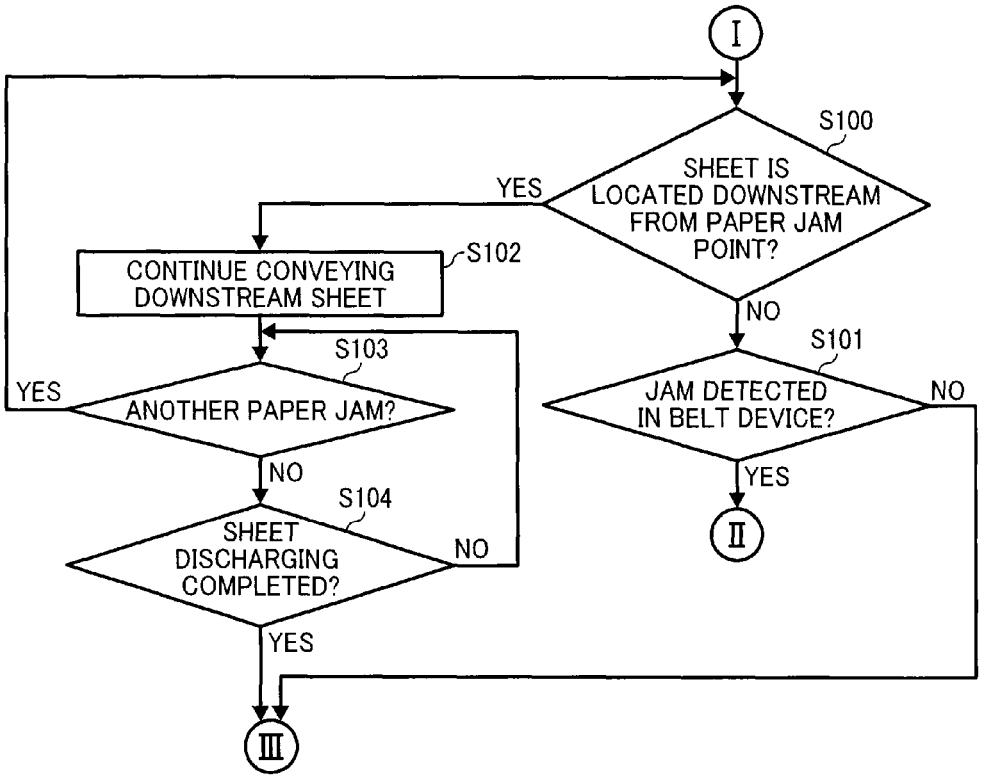
FIG. 9 is a diagram illustrating a control flow of the sheet conveying device as another example applicable to the embodiments of FIGS. 3, 4, 5, and 7.

FIG. 9 is a diagram illustrating another control flow of the sheet conveying device 30 as another example applicable to the examples of FIGS. 3, 4, 5, and 7.

In the examples described with the flowcharts of FIGS. 3, 4, 5, and 7, a paper jam point where the paper jam occurs is not basically specified other than the paper jam point detected based on the detection result obtained by the sensor 500. Accordingly, while the sheet P existing in the pair of holding/conveying belts 90 is discharged from the pair of holding/conveying belts 90 whether or not the sheet P is a jammed sheet P, any non-jammed sheet P located upstream from the sensor 500 remains halted.

For example, the non-jammed sheet P kept between the secondary transfer roller 12 and the fixing device 8 has already finished the secondary transfer, and therefore can be discharged to the sheet discharging tray 20 after completion of a fixing process and a cooling process. Specifically, it is preferable that the sheet P located downstream from the paper jam point is conveyed continuously. The example described here with a flowchart of FIG. 9 relates to this control flow.

Figure 17:
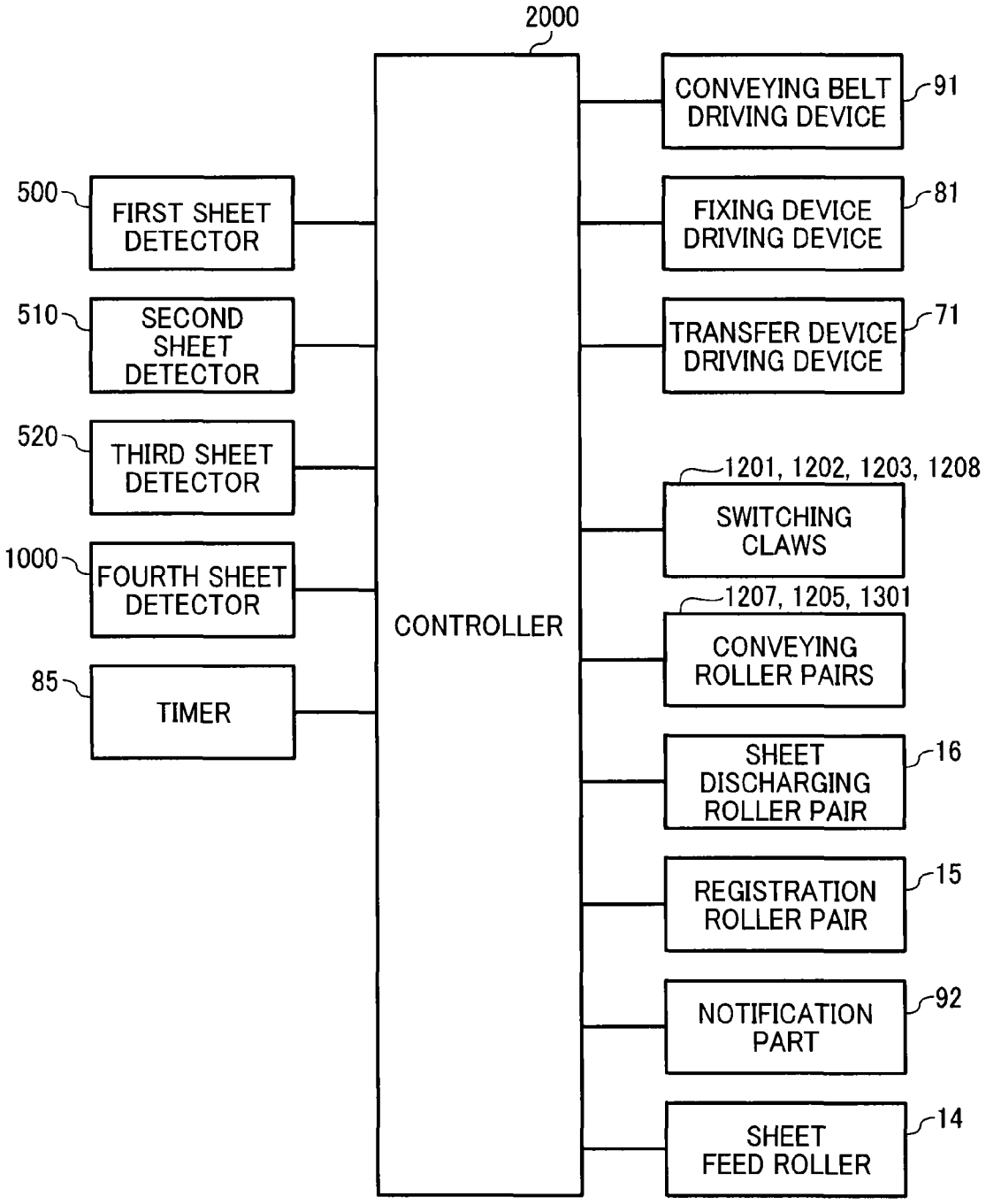
FIG. 17 is a diagram illustrating a block diagram of a controller and connected devices of the image forming apparatus according to an embodiment.

In this example described in the control flow of FIG. 9, multiple sensors 520 are disposed at respective positions corresponding to the registration roller pair 15, the secondary transfer roller 12, and the fixing device 8. Each of the sensors 520 functions as a third sheet detector, as illustrated in FIG. 17. The sensors 520 detect the paper jam at the corresponding positions.

For example, after the sheet P has passed by the third sheet detector (i.e., after the sensor 520 has turned on), a timer 85 (refer to FIG. 17) measures an ON time. Then, when the timer 85 measures a time exceeding a normal passage time of the sheet P, the controller 2000 (refer to FIG. 17) determines that the sheet P is kept (i.e., the paper jam has occurred).

In addition to the sensor 500 and the sensors 520, the sensor 510 that functions another sheet detector is disposed at the exit roller pair 902, so that the sensor 510 can detect whether or not the sheet P is kept in the pair of holding/conveying belts 90.

It is to be noted that the third sheet detector is not limited to a sensor or sensors disposed at the above-described position(s) but a sensor or sensors disposed at a different position or different positions.

In the control flows illustrated in FIGS. 3 through 7, when the controller 2000 determines occurrence of the paper jam based on a detection result whether the sensor detects the sheet ON state or the sheet OFF state (YES in step S1), the controller 2000 checks a paper jam code to specify occurrence of the paper jam at a position corresponding to the paper jam code of the sensor 520. For example, a paper jam code [001] corresponds to a transfer paper jam that is a paper jam occurred at the secondary transfer roller 12 and a paper jam code [002] corresponds to a fixing paper jam that is a paper jam occurred at the fixing device 8.

Next, the controller 2000 determines whether or not there is the sheet P at a position downstream from the paper jam point where the paper jam has been detected (step S100). For example, any one of the multiple sensors 520 detects the paper jam point, the controller 2000 determines whether or not the jammed sheet P is located downstream from the sensor 520 that has detected the paper jam of the multiple sensors 520 (including the sheet detector disposed downstream from the sensor 520 by which the jammed sheet is detected). By contrast, none of the multiple sensors 520 detects the paper jam point, the controller 2000 determines whether or not the jammed sheet P is located downstream from the paper jam point in step S100.

When the controller 2000 determines that there is no sheet at the position downstream from the paper jam point (NO in step S100), the controller 2000 determines whether or not the paper jam point is in the pair of holding/conveying belts 90 (step S101).

When occurrence of the paper jam is detected based on detection results obtained by the sensor 500 or the sensor 510 and the paper jam point is in the pair of holding/conveying belts 90 (YES in step S101), the process of step S3 in FIGS. 3 through 7 is taken. Thereafter, the processes of steps S4 through S6 are taken to complete the series of image forming operations.

When the paper jam point is not in the pair of holding/conveying belts 90 (NO in step S101), the paper jam has occurred at a position upstream from the pair of holding/conveying belts 90 and no sheet is left downstream from the pair of holding/conveying belts 90. Accordingly, the process of step S5 in FIGS. 3 through 7 is taken to stop the driving of the whole driving devices including the pair of holding/conveying belts 90 and the fixing roller 17 immediately. Thereafter, the process of step S6 is taken to complete the series of image forming operations.

By contrast, when the controller 2000 determines that there is the sheet P at the position downstream from the paper jam point (YES in step S100), the devices and components for conveying the sheet P located downstream from the paper jam point are continuously driven (step S102), so that the sheet P is discharged. For example, the paper jam occurs at the secondary transfer roller 12 and the sensor 520 disposed at the fixing device 8 detects the sheet P, a fixing device drive device 81 (refer to FIG. 17) continues to drive the fixing device 8. At this time, since the devices and components for conveying the sheet P downstream from the paper jam point are continuously driven, the controller 2000 determines whether or not any additional paper jam occurs (step S103).

When any additional paper jam occurs (YES in step S103), the controller 2000 again checks whether or not there is the sheet P at a position downstream from the additional paper jam point (step S100).

When the controller 2000 determines that any additional paper jam has not occurred (NO in step S103), the controller 2000 determines whether the sheet P is completely discharged (step S104).

When the sheet P is not discharged completely (NO in step S104), the processes of steps S103 and S104 are performed repeatedly until the sheet P is completely discharged from the sheet discharging roller pair 16.

When the sheet P is completely discharged from the sheet discharging roller pair 16 (YES in step S104), the processes of step S5 in FIGS. 3, 4, 5, and 7 are taken. Then, the paper jam is notified to the users via the notification part 92 (step S6), and the series of image forming operations ends.

Figure 10:
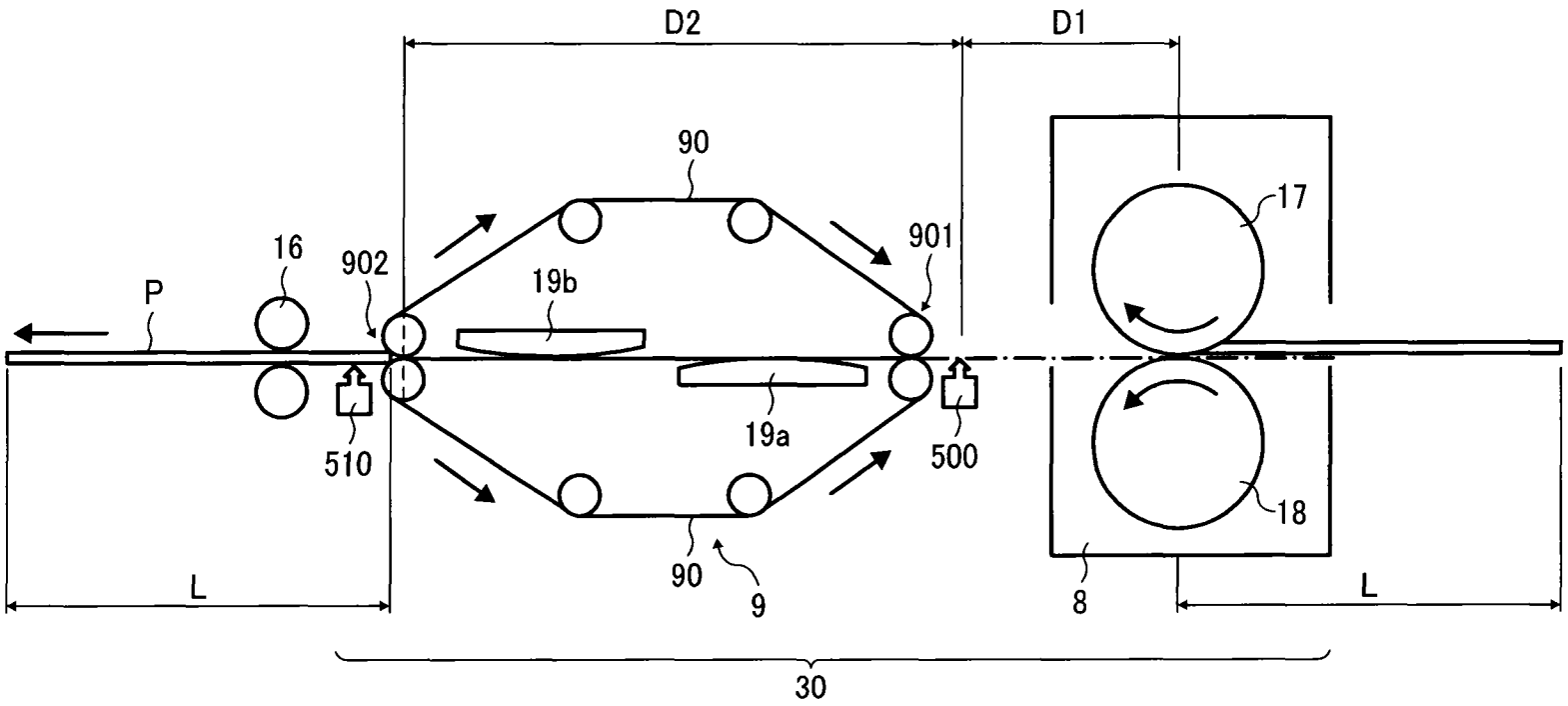
FIG. 10 is a diagram illustrating yet another example of a configuration of the sheet conveying device according to the embodiment.
Figure 11A:
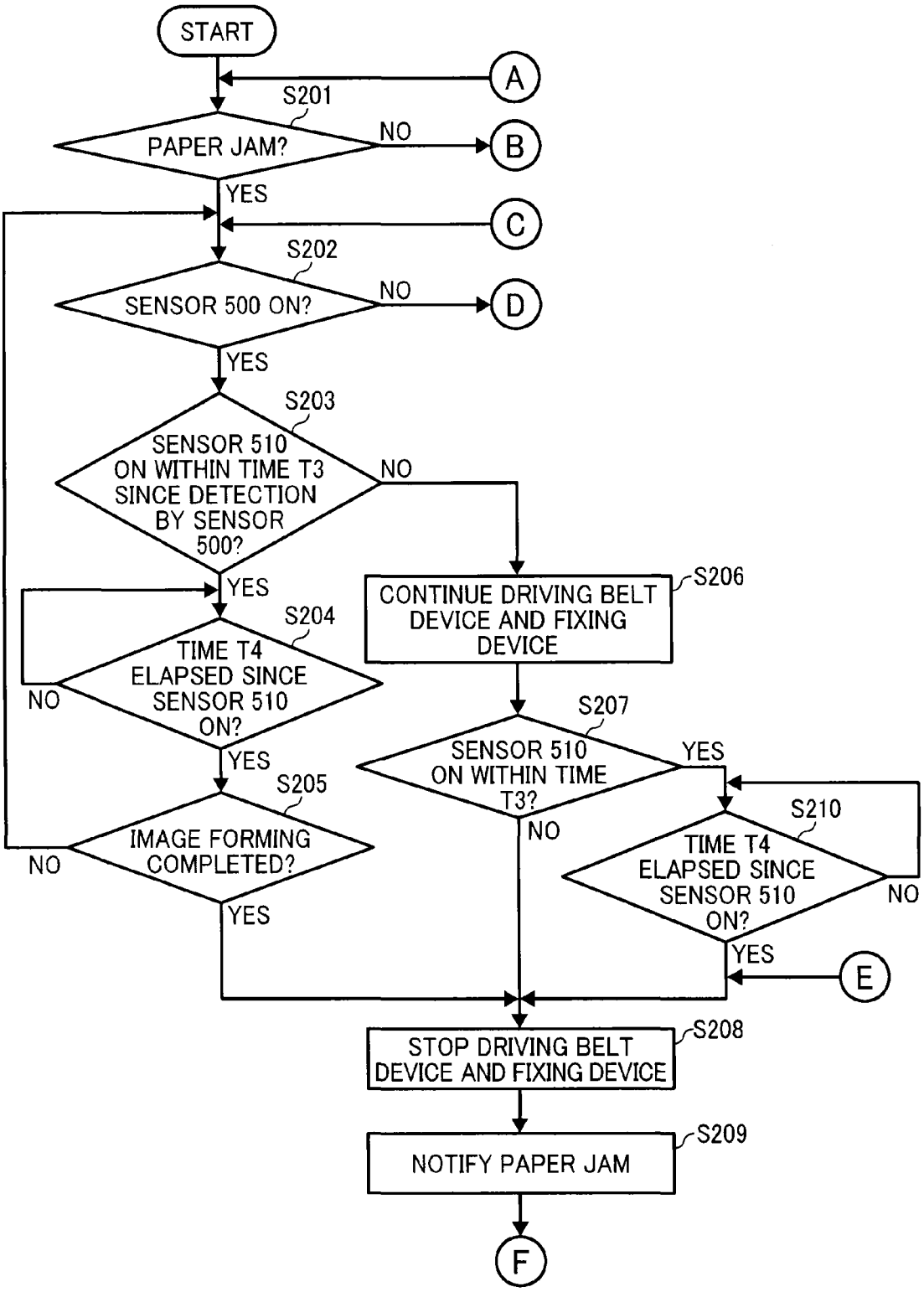
FIGS. 11A and 11B are diagrams separately illustrating a control flow of the sheet conveying device of FIG. 10.
Figure 11B:
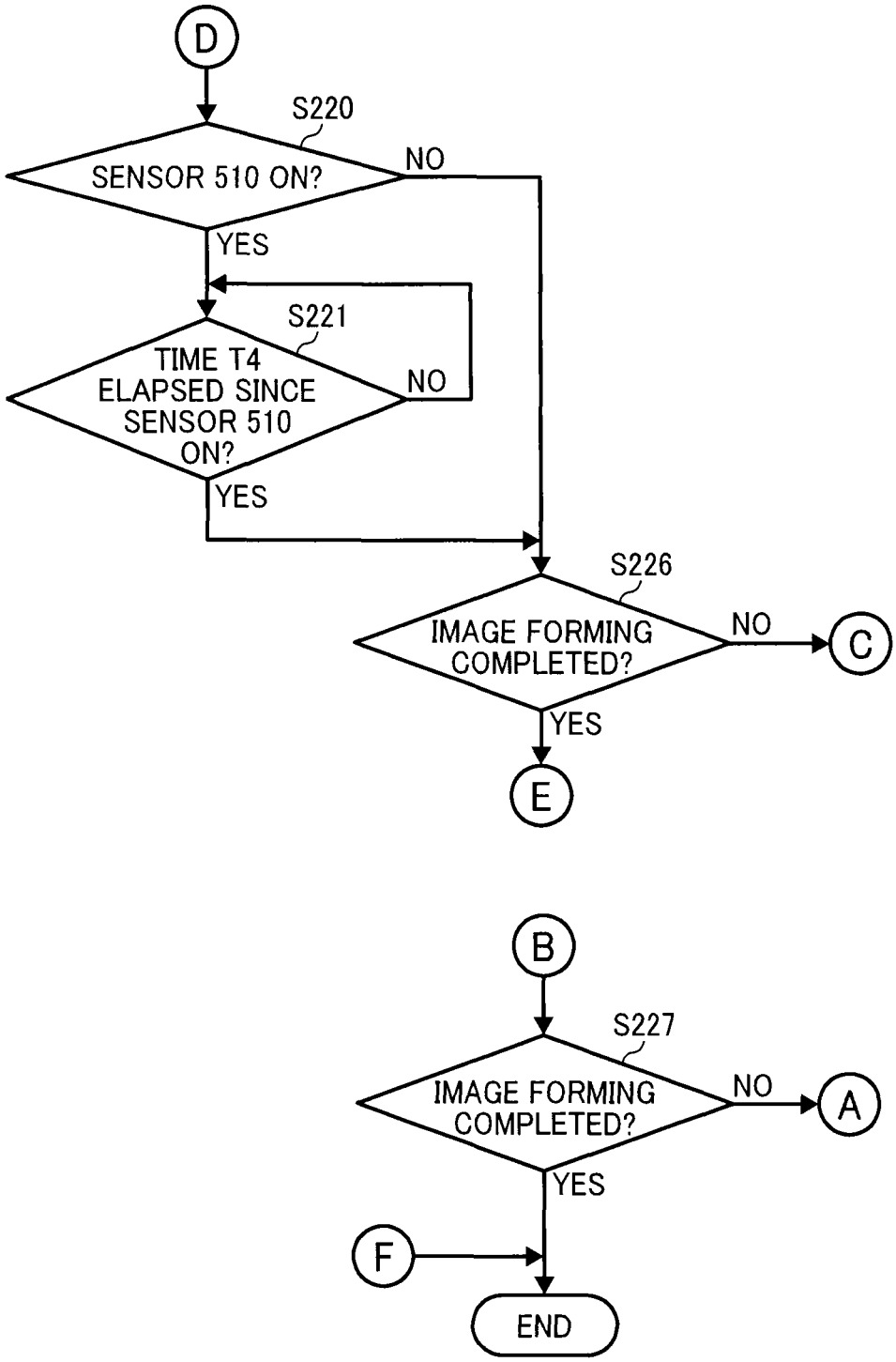

FIG. 10 is a diagram illustrating yet another example of a configuration of the sheet conveying device 30 according to the present embodiment. FIGS. 11A and 11B are diagrams separately illustrating a control flow of the sheet conveying device 30 of FIG. 10.

The sheet detector that detects existence of the sheet P in the cooling device 9 is not limited to detection of the sensor ON/OFF states of the sensors 500 and 510 but may also be applied to detection of the sensor ON state of the sensors 500 and 510, for example. In this case, the controller 2000 determines that the sheet P has entered in the cooling device 9 when the leading edge of the sheet P reaches the sensor 500 to turn on, and the controller 2000 determines that the sheet P has passed through the cooling device 9 when the leading edge of the sheet P reaches the sensor 510 to turn on. However, the sheet P remains across the cooling device 9 and the sensor 510, and therefore the controller 2000 determines that the sheet P has completely passed the cooling device 9 based on the following given conditions. By employing the above-described control that does not determine the sensor OFF state, a program for performing the image forming operations can be simpler.

A description is given of a control flow in which one or more sheets P are printed and a single sheet P is accepted in the cooling device 9, with reference to FIGS. 11A and 11B. Specifically, the single sheet P enters the cooling device 9 when a length of the cooling device 9 in the sheet conveying direction corresponds to the single sheet P or when the sheet conveying operation is controlled to accept the single sheet P in the cooling device 9.

As the series of image forming operations starts in the apparatus body 201 of the image forming apparatus 200, while no paper jam occurs (NO in step S201), the series of the image forming operations continues and the series of image forming operations continues and the sheet conveying device 30 conveys the sheet P to be discharged to the sheet discharging tray 20. Specifically, when the series of image forming operations is not completed (NO in step S227), the above-described processes of step S201 and S227 are performed repeatedly. After completion of the whole series of the image forming operations (YES in step 5227) and completion of proper discharging of the sheet P, the image forming operation ends.

By contrast, when the paper jam occurs anywhere in the sheet conveying path R in the image forming apparatus 200 in the image forming operation (YES in step S201), in a case in which the sensor 500 detects the leading edge of the sheet P (YES in step S202), the controller 2000 determines that the sheet P has entered the cooling device 9. At this time, the pair of holding/conveying belts 90 and the fixing roller 17 are continuously driven. The controller 2000 determines whether or not the sensor 510 disposed downstream from the sensor 500 turns on within a given conveying time, i.e., a third conveying time T3, after the sensor 500 turns on (step S203). The third conveying time T3 is a time from which the leading edge of the sheet P detected by the sensor 500 (hereinafter, also referred to as a detected sheet P) passes the sensor 500 and to which the leading edge of the detected sheet P reaches the sensor 510. The third conveying time T3 is obtained by dividing a distance from the sensor 500 to the sensor 510 by the sheet conveying speed V. When the sensor 510 turns on within the third conveying time T3 (YES in step S203), the trailing edge of the detected sheet P passes through the cooling device 9 successfully. However, even if the sensor 510 turns on within the third conveying time T3, the sheet P has not yet passed through the cooling device 9 completely. Therefore, a time at which the sheet P passes through the cooling device 9 completely is calculated per sheet size as a given conveying time, i.e., a fourth conveying time T4. According to this calculation, the controller 2000 determines whether or not the fourth conveying time T4 has elapsed since the sensor 510 turns on (step S204). The fourth conveying time T4 is a time obtained by dividing the length L (i.e., the length of the sheet P in the sheet conveying direction) by the sheet conveying speed V.

When the fourth conveying time T4 has not yet elapsed since the sensor 510 turns on (NO in step S204), the process of step S204 is performed repeatedly until the fourth conveying time T4 elapses.

When the fourth conveying time T4 has elapsed since the sensor 510 turns on (YES in step S204), the controller 2000 determines that the trailing edge of the sheet P has completely passed through the cooling device 9 successfully. Then, the controller 2000 determines whether the series of the image forming operations is completed or a subsequent sheet P is conveyed (step S205).

When the series of the image forming operations is not completed (NO in step S205), the process of step S202 is taken again to determine whether or not the sensor 500 turns on by the subsequent sheet P. When the sensor 500 turns on by the subsequent sheet P (YES in step S202), the processes of steps S203 and S204 are taken to continuously drive the fixing device 8 and the pair of holding/conveying belts 90 by an additional given time and completely discharge the subsequent sheet P from the cooling device 9 completely.

By contrast, after the detected sheet P or the subsequent sheet P has been discharged (YES in step S204), when the series of the image forming operations have been completed (YES in step S205), driving of the whole driving devices including the pair of holding/conveying belts 90 and the fixing roller 17 is stopped (step S208). Then, the paper jam is notified to the users via the notification part 92 (step S209), and the series of image forming operations ends.

However, the processes of completing the series of image forming operations are not limited to the above-described processes. For example, instead of the above-described process performed of step S205, the controller 2000 may determine whether or not the sensor 500 turns on by the subsequent sheet P in step S205. When the sensor 500 turns on by the subsequent sheet P, the process of step S203 is taken to control the sheet conveying operation of the subsequent sheet P.

By contrast, when the sensor 510 does not turn on by the detected sheet P or the subsequent sheet P within the third conveying time T3 even after the sensor 500 turns on by the detected sheet P or the subsequent sheet P (NO in step S203), the sheet P is not conveyed in the pair of holding/conveying belts 90 successfully and is left in the cooling device 9. Therefore, the pair of holding/conveying belts 90 and the fixing roller 17 are continuously driven again (step S206) to discharge the detected sheet P or the subsequent sheet P from the pair of holding/conveying belts 90. This process of step S206 can prevent adhesion of toner to the pair of holding/conveying belts 90 caused by the sheet P kept in the pair of holding/conveying belts 90. Then, the controller 2000 determines whether or not the sensor 510 turns on by the leading edge of the sheet P within the third conveying time T3 (step S207).

When the sensor 510 turns on by the leading edge of the sheet P within the third conveying time T3 (YES in step S207), after the fourth conveying time T4 has elapsed for the sheet P to pass through the cooling device 9 completely (YES in step S210), the driving of the whole driving devices including the pair of holding/conveying belts 90 and the fixing roller 17 is stopped (step S208). Then, the paper jam is notified to the users via the notification part 92 (step S209), and the series of image forming operations ends.

When the fourth conveying time T4 has not elapsed for the sheet P to pass through the cooling device 9 completely (NO in step S210), the process of step S210 is repeatedly performed until the fourth conveying time T4 elapses for the sheet P to pass through the cooling device 9.

When the sensor 510 is not turned on by the leading edge of the sheet P within the third conveying time T3 (NO in step S207), the sheet P remaining in the pair of holding/conveying belts 90 is no longer conveyed for some reason. In this case, the driving of the whole driving devices including the pair of holding/conveying belts 90 and the fixing roller 17 is stopped (step S208), so as to prevent adhesion of toner to and/or damage to the pair of holding/conveying belts 90 caused by contacting and scratching the sheet P and the pair of holding/conveying belts 90 with each other. Then, the paper jam is notified to the users via the notification part 92 (step S209), and the series of image forming operations ends.

When the sensor 500 is not turned on by the leading edge of the sheet P in the event of the paper jam (NO in step S202), the controller 2000 determines whether or not the sensor 510 turns on by the sheet P (step S220).

When the sensor 510 turns on by the sheet P (YES in step S220), the sheet P detected by the sensor 510 can be located across the sensor 510 and the cooling device 9. Therefore, the controller 2000 determines whether or not the fourth conveying time T4 has elapsed since the sensor 510 turns on (step S221).

When the fourth conveying time T4 has not elapsed since the sensor 510 turns on (NO in step S221), the process of step S221 is performed repeatedly until the fourth conveying time T4 elapses.

When the fourth conveying time T4 has elapsed (YES in step S221), there is no sheet left in the cooling device 9. Therefore, the controller 2000 determines whether or not the series of the image forming operations is completed, that is, whether or not there is a subsequent sheet P in the sheet conveying path R in the image forming apparatus 200 (step S226).

When the series of the image forming operations is completed (YES in step S226), the driving of the whole driving devices including the pair of holding/conveying belts 90 and the fixing roller 17 is stopped (step S208). Then, the paper jam is notified to the users via the notification part 92 (step S209), and the series of image forming operations ends.

By contrast, when neither the sensor 500 nor the sensor 510 turns on (NO in step S220), the controller 2000 determines whether or not the series of the image forming operations is completed (step S226). According to the result of determination, the process of step S202 or S208 is taken.

When the series of image forming operations is not completed (NO in step S226), the process of step S202 is taken.

Figure 12:
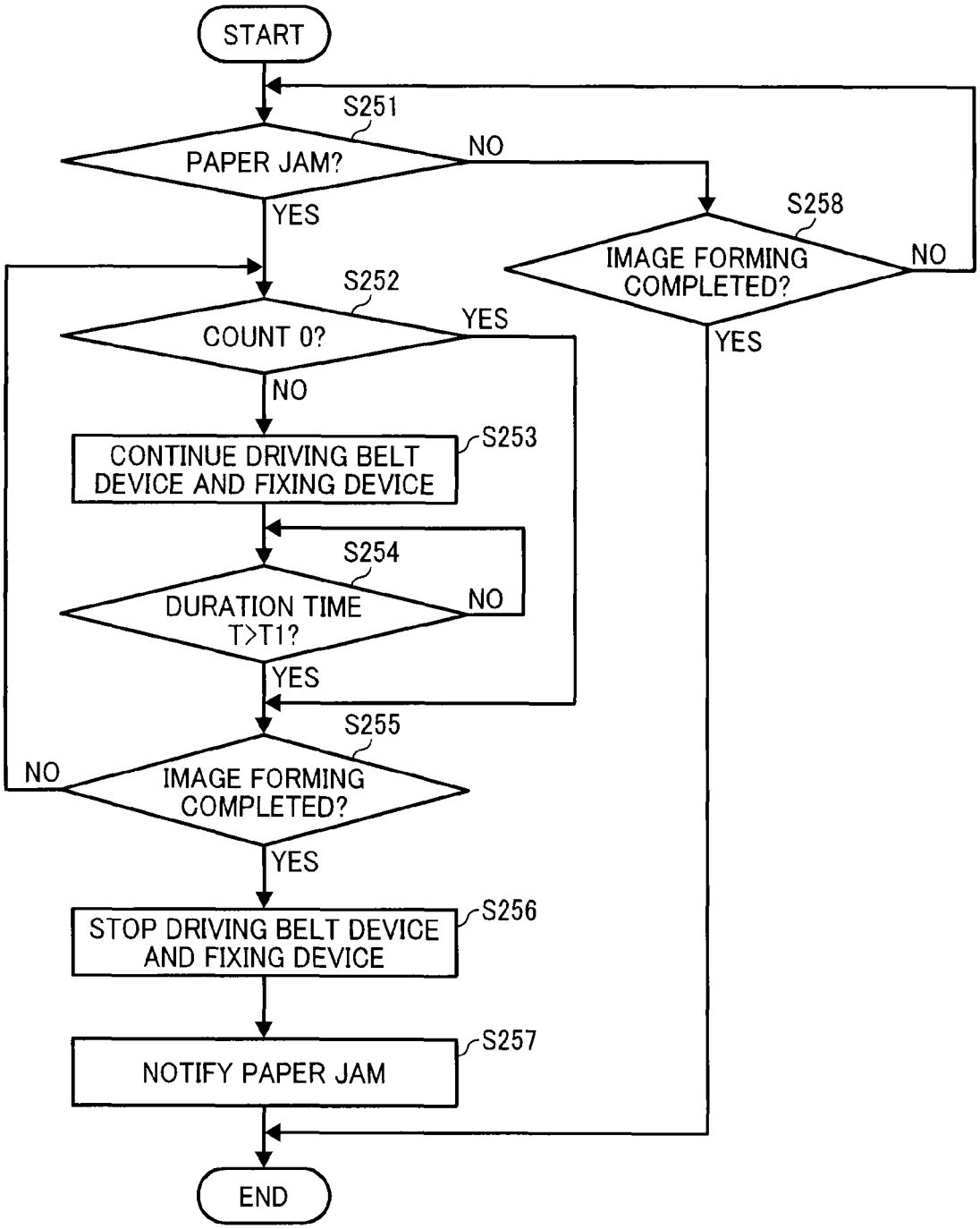
FIG. 12 is a diagram illustrating a control flow of the sheet conveying device as another example of the control flow of FIGS. 11A and 11B.

A description is given of a control flow in which multiple sheets P are printed and the multiple sheets P are accepted at once in the cooling device 9, with reference to FIG. 12.

FIG. 12 is a diagram illustrating a control flow of the sheet conveying device 30 as another example of the control flow of FIGS. 11A and 11B. For example, the multiple sheets P enter the cooling device 9 having the length of the cooling device 9 in the sheet conveying direction corresponding to given multiple sheets P.

It is to be noted that this example of the control flow with reference to FIG. 12 is not limited to when the multiple sheets P are accepted at once in the cooling device 9, but can be applied to the case in which the single sheet P is accepted to enter the cooling device 9 as illustrated in FIGS. 11A and 11B.

In this control flow illustrated in FIG. 12, the numbers of times when the sensor 500 and the sensor 510 turn on are counted in a program. This counting the numbers in the program determines the state in which the sheet P exists in the cooling device 9 and the state in which the sheet P does not exist in the cooling device 9.

For example, when the sensor 500 illustrated in FIG. 10 is changed to the sensor ON state by a first sheet P, a counter counts up "1" in the program. This shows that the first sheet P is in the cooling device 9. Then, when the sensor 510 turns on by the first sheet P, the counter adds "−1" so as to count "0" in the program. This shows that the first sheet P is not in the cooling device 9.

Next, after the first sheet P turns on the sensor 500 (counting "1" in the program) before turning on the sensor 510, a second sheet P turns on the sensor 500. In this case, another "1" is additionally counted in the program. As a result, the total count is 2. This shows that two sheets P (e.g., the first and second sheets P) are in the cooling device 9. Then, the first sheet P turns on the sensor 510, and therefore "−1" is added to the count "2", so that "1" is counted in the program. This shows that one sheet P (e.g., the second sheet P) is in the cooling device 9. Further, the second sheet P turns on the sensor 510, and therefore "−1" is added to the count "1", so that "0" is counted in the program. This shows that no sheet is left in the cooling device 9.

Accordingly, when the sensor 500 turns on in the sensor ON state, "1" is added to count "1" in the program, and when the sensor 510 turns on in the sensor ON state, "−1" is added to count "0" in the program. In a case in which the count is "0", there is no sheet left in the cooling device 9. By contrast, in a case in which the count is "3", there are three sheets P left in the cooling device 9.

As illustrated in FIG. 12, as the series of image forming operations starts in the apparatus body 201 of the image forming apparatus 200, while no paper jam occurs (NO in step S251), the series of image forming operations continues and the sheet conveying device 30 conveys the sheet P to be discharged to the sheet discharging tray 20. Specifically, when the series of image forming operations is not completed (NO in step S258), the above-described processes of step S251 and S258 are performed repeatedly. After completion of the whole series of image forming operations (YES in step S258) and completion of proper discharging of the sheet P, the image forming operation ends.

By contrast, when the paper jam occurs anywhere in the sheet conveying path R in the image forming apparatus 200 in the image forming operation (YES in step S251), in a case in which the number of counts of the sensor ON state of the sensor 500 is greater than the number of counts of the sensor ON state of the sensor 510 and the count is not "0" (NO in step S252), the controller 2000 determines that the sheet P exists in the cooling device 9. At this time, regardless of the count value, the pair of holding/conveying belts 90 and the fixing roller 17 are continuously driven for the first conveying time T1 (step S253) to discharge the whole sheet(s) P existing in the cooling device 9.

When the driving operation duration time T is equal to or smaller than the first conveying time T1 ($T \leq T1$) (NO in step S254), the process of step S254 is performed repeatedly until the driving operation duration time T turns greater than the first conveying time T1 ($T > T1$).

When the driving operation duration time T turns greater than the first conveying time T1 ($T > T1$) (YES in step S254), the controller 2000 determines whether or not the series of image forming operations is completed (step S255).

When the series of image forming operations is completed (YES in step S255), the driving of the whole driving devices including the pair of holding/conveying belts 90 and the fixing roller 17 is stopped (step S256). Then, the paper jam is notified to the users via the notification part 92 (step S257), and the series of image forming operations ends.

When the series of image forming operations is not completed (NO in step S255), the processes of steps S252 through S255 are taken to determine whether or not there is the subsequent sheet P. If there is no subsequent sheet P while the processes of steps S252 through S255 are repeatedly performed, after the whole sheets P that have turned on the sensor 500 turn on the sensor 510, the count value is changed to "0" (YES in step S252). When the count value is "0" and the series of the image forming operations is completed (YES in step S255), the driving of the whole driving devices including the pair of holding/conveying belts 90 and the fixing roller 17 is stopped (step S256). Then, the paper jam is notified to the users via the notification part 92 (step S257), and the series of image forming operations ends.

When the paper jam occurs anywhere in the sheet conveying path R in the image forming apparatus 200 in the image forming operation (YES in step S251) and the count value is "0" (YES in step S252), the controller 2000 determines that there is no sheet P left in the cooling device 9. Then, the process jumps to step S255 to determine whether or not the series of image forming operations is completed.

Figure 13:
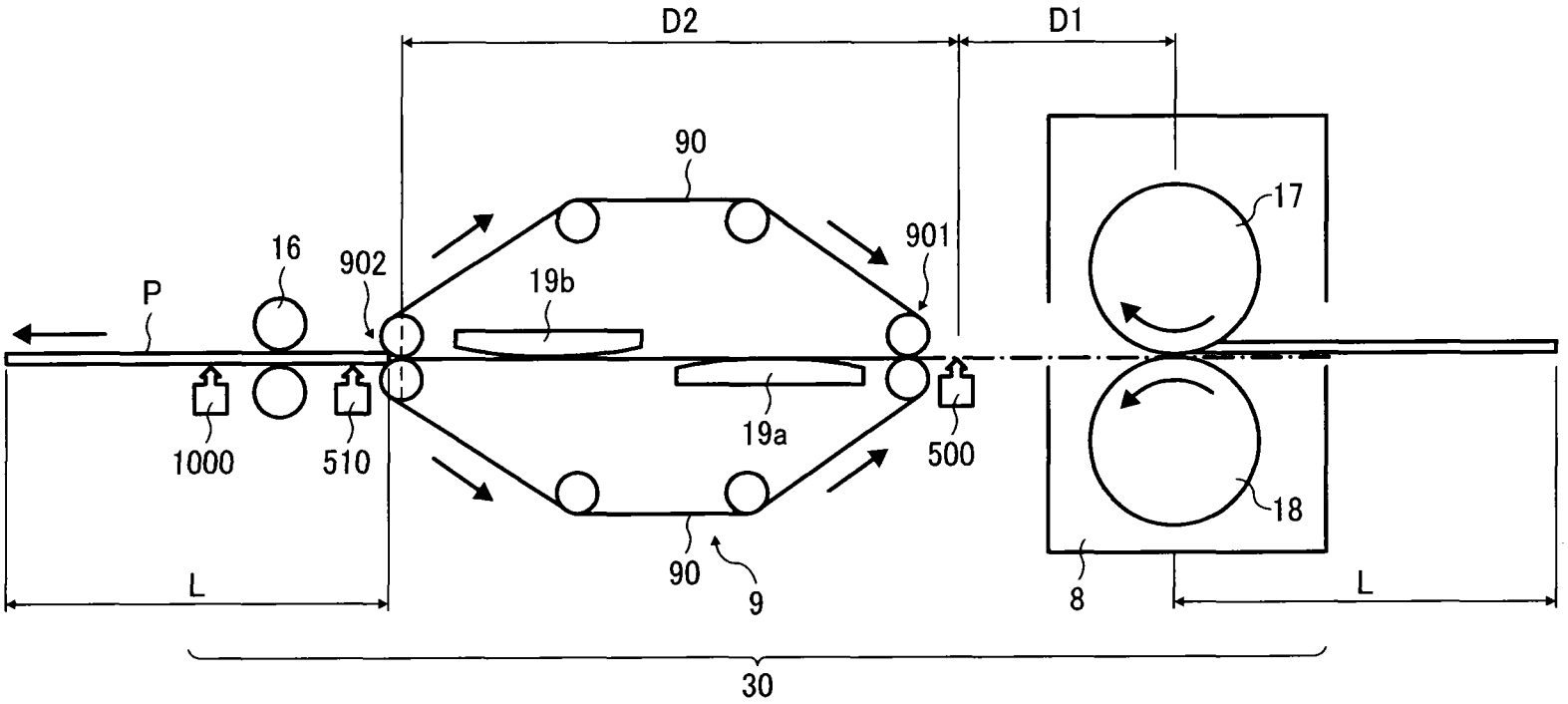
FIG. 13 is a diagram illustrating yet another example of a configuration of the sheet conveying device according to the embodiment.

FIG. 13 is a diagram illustrating yet another example of a configuration of the sheet conveying device 30 according to the above-described embodiment.

The elements or components of the sheet conveying device 30 illustrated in FIG. 13 are basically identical in structure and functions to the elements or components of the sheet conveying device 30 illustrated in FIG. 10, except that the sheet conveying device 30 illustrated in FIG. 13 further includes a sensor 1000 that functions as a fourth sheet detector to detect whether the sheet P is still in the pair of holding/conveying belts 90.

Figure 14A:
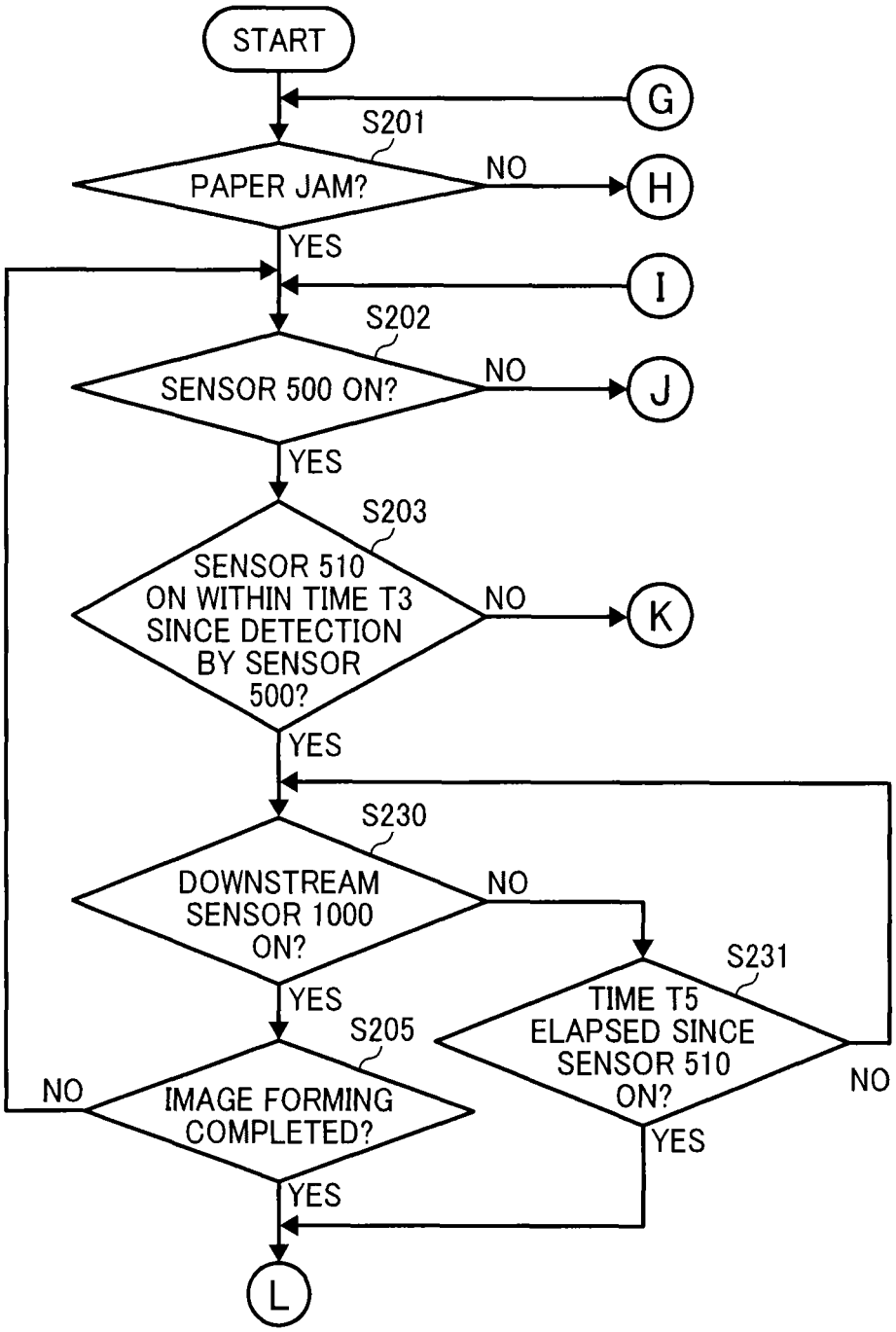
FIGS. 14A and 14B are diagrams separately illustrating a control flow of the sheet conveying device of FIG. 9 as another example of the control flow of FIGS. 11A and 11B.
Figure 14B:
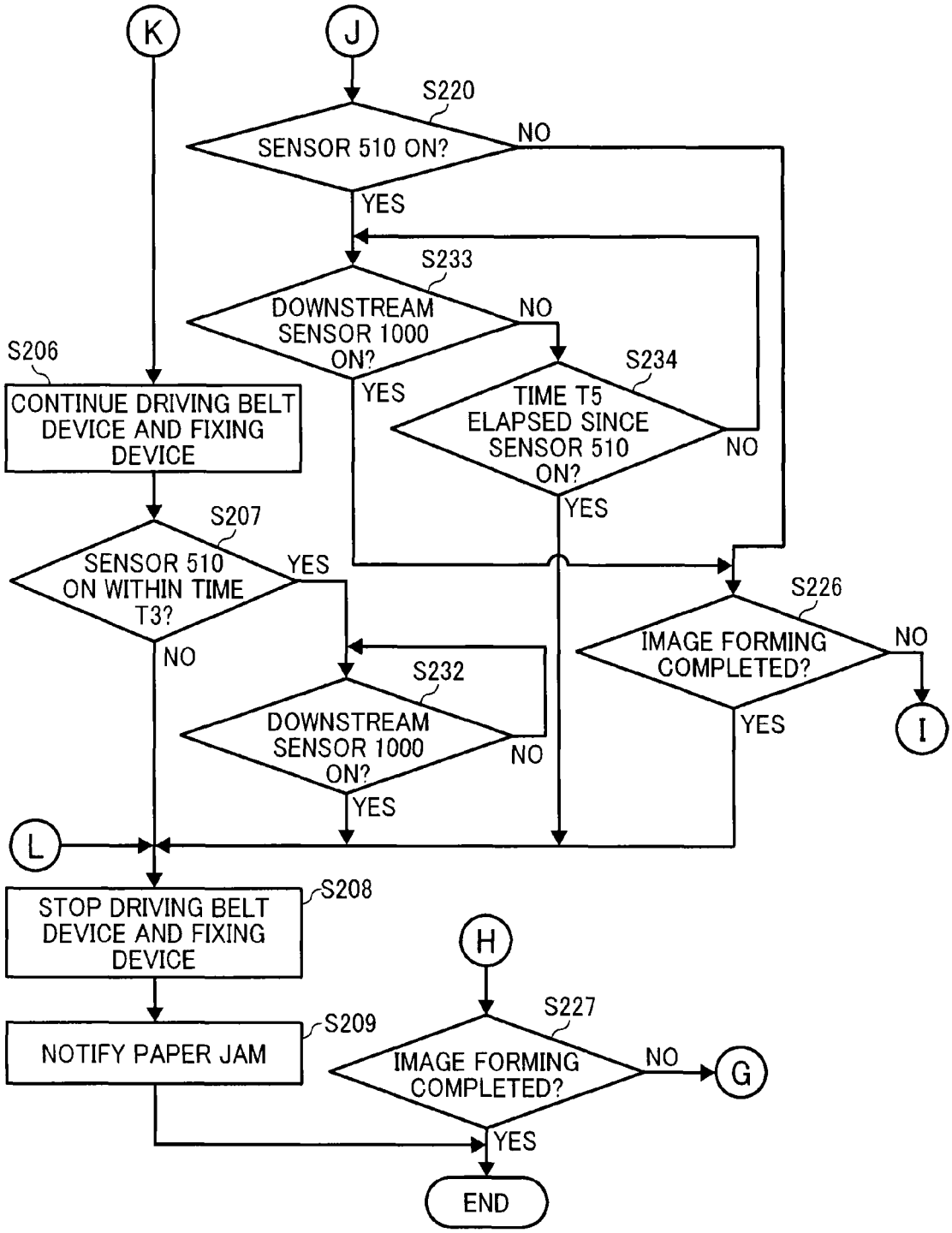

FIGS. 14A and 14B are diagrams separately illustrating a control flow of the sheet conveying device of FIG. 13 as another example of the control flow of FIGS. 11A and 11B.

In this control flow illustrated in FIGS. 14A and 14B, after the sensor 510 has detected the leading edge of the sheet P, the sensor 1000 that functions as a fourth sheet detector detects the leading edge of the sheet P. By so doing, the controller 2000 determines that the trailing edge of the sheet P has passed through the cooling device 9 (step S230).

In this control flow of FIGS. 14A and 14B, the sensor 1000 is disposed at a position at which the trailing edge of the sheet P passes through the cooling device 9 when the leading edge thereof reaches the sensor 1000. For example, the sensor 1000 is disposed at which a sheet P having the maximum size that is acceptable in the image forming apparatus 200 passes through the cooling device 9.

Specifically, as the series of image forming operations starts in the apparatus body 201 of the image forming apparatus 200, while no paper jam occurs (NO in step S201), the series of the image forming operations continues and the series of the image forming operations continues and the sheet conveying device 30 conveys the sheet P to be discharged to the sheet discharging tray 20. When the series of the image forming operations is not completed (NO in step S227), the above-described processes of step S201 and S227 are performed repeatedly. After completion of the whole series of image forming operations (YES in step S227) and completion of proper discharging of the sheet P, the image forming operation ends.

When the paper jam occurs anywhere in the sheet conveying path R in the image forming apparatus 200 in the image forming operation (YES in step S201), in a case in which the sensor 500 detects the leading edge of the sheet P (YES in step S202), the controller 2000 determines whether or not the sensor 510 disposed downstream from the sensor 500 turns on within the third conveying time T3, after the sensor 500 turns on (step S203).

When the sensor 510 turns on within the third conveying time T3 (YES in step S203), the controller 2000 determines whether or not the sensor 1000 turns on (step S230). When the controller 2000 determines that the sensor 1000 turns on (YES in step S230), the controller 2000 determines whether the series of image forming operations is completed or the subsequent sheet P is conveyed (step S205).

When the series of the image forming operations is not completed (NO in step S205), the process of step S202 is taken again to determine whether or not the sensor 500 turns on by the subsequent sheet P. When the controller 2000 determines the series of image forming operations is completed (YES in step S205), the driving of the whole driving devices including the pair of holding/conveying belts 90 and the fixing roller 17 is stopped (step S208). Then, the paper jam is notified to the users via the notification part 92 (step S209), and the series of image forming operations ends.

When the controller 2000 determines that the sensor 1000 does not turn on (NO in step S203), the pair of holding/conveying belts 90 and the fixing roller 17 are continuously driven (step S206). Then, the controller 2000 determines whether or not the sensor 510 turns on by the leading edge of the sheet P within the third conveying time T3 (step S207).

When the sensor 510 is not turned on by the leading edge of the sheet P within the third conveying time T3 (NO in step S207), the driving of the whole driving devices including the pair of holding/conveying belts 90 and the fixing roller 17 is stopped (step S208). Then, the paper jam is notified to the users via the notification part 92 (step S209), and the series of image forming operations ends.

By contrast, when the controller 2000 determines that the sensor 1000 does not turn on (NO in step S230), the controller 2000 determines whether or not the sensor 1000 turns on within a given conveying time, i.e., a fifth conveying time T5 (step S231). The fifth conveying time T5 is obtained by dividing a distance from the sensor 510 to the sensor 1000 by the sheet conveying speed V.

When the sensor 1000 is not turned on within the fifth conveying time T5 after the sensor 510 has been turned on (NO in step S231), the above-described process of step S230 is performed again.

When the sensor 1000 turns on (YES in step S231), the controller 2000 determines that the sheet P exists in the cooling device 9. In this case, the driving of the whole driving devices including the pair of holding/conveying belts 90 and the fixing roller 17 is stopped (step S208). Then, the paper jam is notified to the users via the notification part 92 (step S209), and the series of image forming operations ends.

When the sensor 510 turns on by the leading edge of the sheet P within the third conveying time T3 (YES in step S207), the controller 2000 determines whether or not the sensor 1000 turns on (step S232). When the controller 2000 determines that the sensor 1000 turns on (YES in step S232), the driving of the whole driving devices including the pair of holding/conveying belts 90 and the fixing roller 17 is stopped (step S208). Then, the paper jam is notified to the users via the notification part 92 (step S209), and the series of image forming operations ends.

When the sensor 1000 is not turned on (NO in step S232), the process of step S232 is repeatedly performed until the sensor 1000 turns on.

When the sensor 500 is not turned on by the leading edge of the sheet P in the event of the paper jam (NO in step S202), the controller 2000 determines whether or not the sensor 510 turns on by the sheet P (step S220).

When the sensor 510 turns on by the sheet P (YES in step S220), the controller 2000 determines whether or not the sensor 1000 turns on (step S233). When the controller 2000 determines that the sensor 1000 turns on (YES in step S233), it is then determined whether or not the series of the image forming operations is completed, that is, whether or not there is a subsequent sheet P in the sheet conveying path R in the image forming apparatus 200 (step S226).

When the series of the image forming operations is completed (YES in step S226), the driving of the whole driving devices including the pair of holding/conveying belts 90 and the fixing roller 17 is stopped (step S208). Then, the paper jam is notified to the users via the notification part 92 (step S209), and the series of image forming operations ends.

When the series of the image forming operations is not completed (NO in step S226), the process of step S202 is performed again.

When the controller 2000 determines that the sensor 1000 is not turned on (NO in step S233), it is then determined whether or not the sensor 510 turns on within the fifth conveying time T5 (step S234).

When the sensor 510 does not turn on within the fifth conveying time T5 (NO in step S234), the above-described process of step S233 is performed again.

When the sensor 510 turns on within the fifth conveying time T5 (YES in step S234), the processes of steps S208 and S209 are taken, and the series of image forming operations ends.

In the above-described embodiment, the sheet P is discharged to the sheet discharging tray 20 whether or not the sheet P existing in the cooling device 9 is to be discharged. However, as illustrated in FIG. 15, the sheet P may be discharged to a purge tray 1100 in which jammed sheets P are stored or conveyed to a duplex conveying path 1300.

Figure 15:
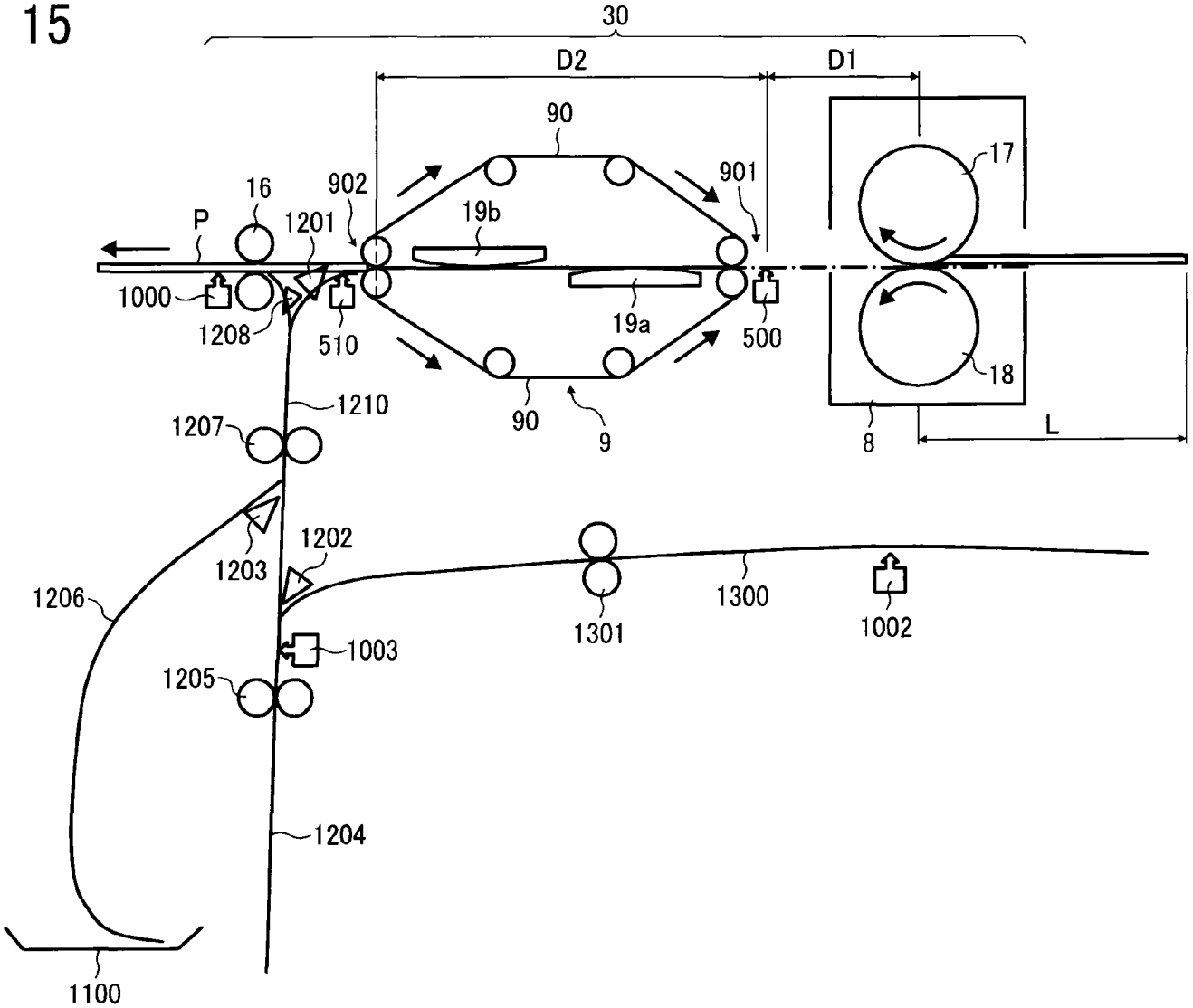
FIG. 15 is a diagram illustrating another example of a configuration of the image forming apparatus according to the embodiment.
Figure 16A:
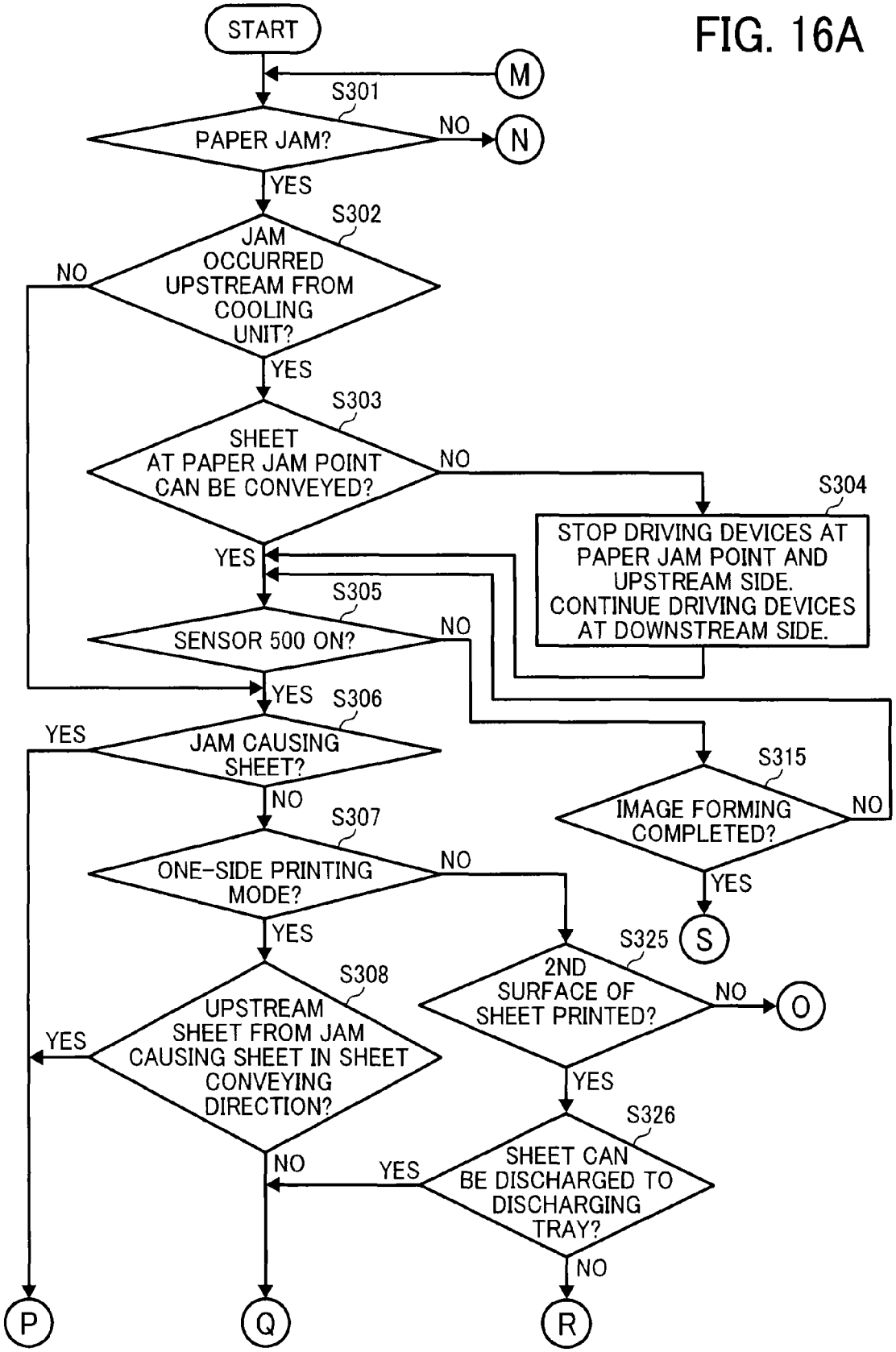
FIGS. 16A through 16C are diagrams separately illustrating a control flow of the image forming apparatus of FIG. 15.
Figure 16B:
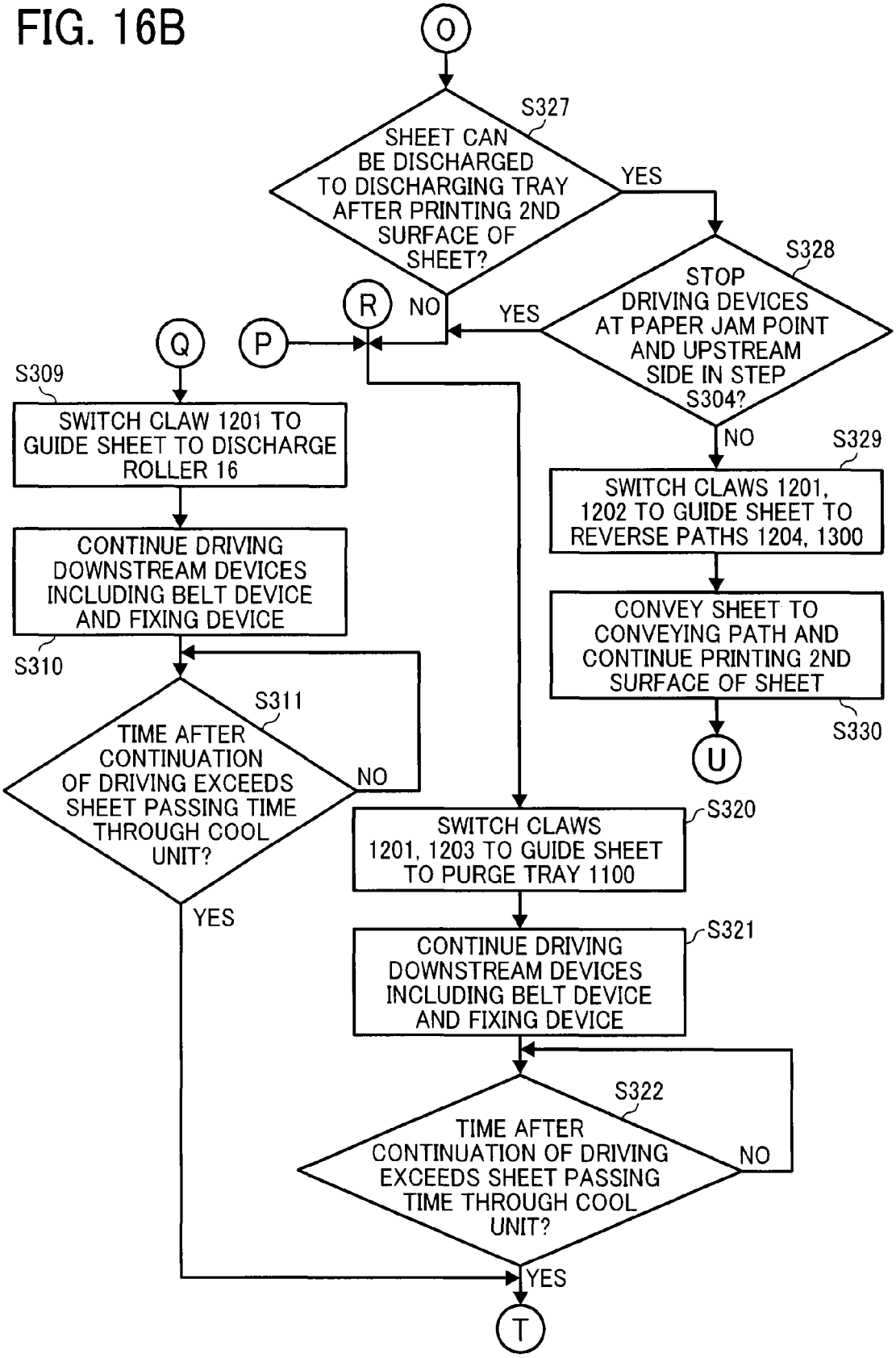
Figure 16C:
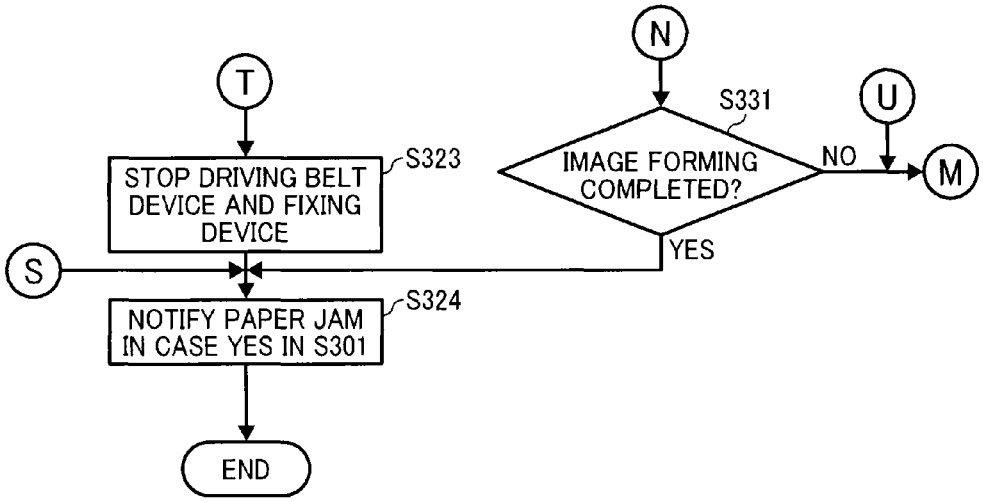

FIG. 15 is a diagram illustrating another example of a configuration of the image forming apparatus 200 according to the above-described embodiment. FIGS. 16A-16C are diagrams separately illustrating a control flow of the image forming apparatus 200 of FIG. 15.

In the image forming apparatus 200 according to the present embodiment, the same reference numerals are applied to the devices and components having the same structure and function as those provided in the image forming apparatus 200 of FIG. 1.

The image forming apparatus 200 includes the sheet discharging roller pair 16, the purge tray 1100, a conveying path 1206, reverse paths 1204 and 1210, a duplex conveying path 1300, switching claws 1201, 1202, 1203, and 1208, and sensors 1002 and 1003. The sheet discharging roller pair 16 is disposed downstream from the cooling device 9 in the sheet conveying direction and functions as a sheet discharging part to discharge the sheet P to an outside of the apparatus body 201 of the image forming apparatus 200. The purge tray 1100 is disposed in the sheet conveying device 30 and functions as a sheet reservoir to store multiple sheets P therein. The conveying path 1206 is a path through which the sheet P is conveyed to the purge tray 1100. The reverse paths 1204 and 1210 are path through which the sheet P is reversed. The duplex conveying path 1300 is a path through which the sheet P is conveyed during the duplex printing. The switching claws 1201, 1202, 1203, and 1208 are provided to switch the direction of conveyance of the sheet P while the sheet P is conveyed in the conveying path 1206, the reverse paths 1204 and 1210, and the duplex conveying path 1300, respectively. The sheet conveying roller pairs 1205 and 1207 rotate in a direction to guide the sheet P to the reverse path 1204. The sheet conveying roller pair 1301 rotates in both forward and reverse directions to guide the sheet P for duplex printing. The sensor 1002 is disposed downstream from the sheet conveying roller pair 1301 disposed in the duplex conveying path 1300 in a reverse direction of the sheet conveying direction so as to detect whether or not the sheet P has entered the duplex conveying path 1300. The sensor 1003 is disposed between the sheet conveying roller pair 1205 and the switching claw 1202 so as to detect whether or not the sheet P has entered the reverse path 1204.

A description is given of the sheet conveying operation in the apparatus body 201 of the image forming apparatus 200 as illustrated in FIG. 15.

As the sheet P passes through the cooling device 9, the switching claw 1201 that is disposed between the sensor 510 and the sheet discharging roller pair 16 is switched based on the image forming operation, which are a single-side copy operation and a duplex copy operation.

In the single-side copy operation, when the sheet P is discharged to the sheet discharging tray 20 in a face down manner, the switching claw 1201 is switched to a given side so that the sheet P is guided to the reverse path 1204. Sheet conveying roller pairs 1205 and 1207 rotate in a direction to guide the sheet P to the reverse path 1204. After the sheet P is guided to the reverse path 1204 and is stopped, the sheet conveying roller pairs 1205 and 1207 rotate reversely to convey the sheet P upwardly. Then, the switching claw 1208 is switched to a direction to guide the sheet P to the sheet discharging roller pair 16. The sheet P is conveyed to the sheet discharging roller pair 16 to be discharged with the face down.

In the duplex copy operation to print a second surface or a back surface of the sheet P, the switching claw 1201 is switched to the given side so that the sheet P is guided to the reverse path 1204. The sheet conveying roller pairs 1205 and 1207 rotate in the direction to guide the sheet P to the reverse path 1204. After the sheet P is guided to the reverse path 1204 and is stopped, the sheet conveying roller 1205 rotates reversely to convey the sheet P upwardly. Then, the switching claw 1202 is switched to a direction to guide the sheet P to the duplex conveying path 1300. After being conveyed to the duplex conveying path 1300, the sheet P is conveyed to the registration roller pair 15 to print an image on the second surface of the sheet P.

It is to be noted that, in a case in which a first (front) surface and the second (back) surface of the sheet P are printed as an odd page and an even page, respectively, and the sheet P is discharged with the first surface facing down, the switching claw 1201 is switched to the given side to guide the sheet P to the sheet discharging roller pair 16. By so doing, the sheet P is discharged to the sheet discharging tray 20 with the odd page facing down.

By contrast, in a case in which the first (front) surface and the second (back) surface of the sheet P are printed as the even page and the odd page, respectively, the sheet P having the second surface printed passes through the cooling device 9 with the odd page facing up. Therefore, same as the single-side copy operation, the sheet P is guided to the reverse path 1204 and then switched back so as to be discharged by the sheet discharging roller pair 16.

The purge tray 1100 is disposed in the apparatus body 201 of the image forming apparatus 200 and adjacent to the reverse path 1204 to store jammed sheets P or non-discharging sheets P. Non-discharging sheets P are, for example, sheets P not yet having completed the processes of the second surface in the transfer device 7 and/or the fixing device 8, sheets P having completed the processes for the second surface in the transfer device 7 and the fixing device 8 and possibly causing disarrangement of the page order, or sheets P having led to the paper jam (also referred to jam causing sheets P). To discharge these sheets P to the purge tray 1100, the switching claw 1201 is switched to a given side to guide the sheet P to the reverse path 1210, and the switching claw 1203 is switched to a direction to guide the sheet P to the conveying path 1206. By so doing, the sheet P is conveyed to and stored in the purge tray 1100.

FIGS. 16A-16C are the control flow of the image forming apparatus 200 of FIG. 15, illustrated in three divided sheets P.

When no paper jam occurs (NO in step S301), the series of image forming operations continues and the sheet conveying device 30 conveys the sheet P to be discharged to the sheet discharging tray 20. Specifically, when the series of the image forming operations is not completed (NO in step S331), the above-described processes of step S301 and S331 are performed repeatedly. After completion of the whole series of image forming operations (YES in step S331), the paper jam is notified to the users via the notification part 92 in a case in which the paper jam has occurred or YES in step S301 (step S324). Otherwise, the image forming operation ends.

When the paper jam occurs anywhere in the sheet conveying path R in the image forming apparatus 200 in the image forming operation (YES in step S301), the controller 2000 determines whether or not the paper jam has occurred at a position upstream from the cooling device 9 in the sheet conveying direction (step S302).

When the controller 2000 determines that the paper jam has occurred at the position upstream from the cooling device 9 in the sheet conveying direction (YES in step S302), the controller 2000 determines whether or not the jam causing sheet P can be conveyed further (step S303).

When the controller 2000 determines that jam causing sheet can be conveyed further (YES in step S303), a process of step S305 is then performed, which is described below.

When the controller 2000 determines that the jam causing sheet P cannot be conveyed further (NO in step S303), driving of the devices and components at and upstream from the position of the paper jam is stopped (step S304).

By contrast, when the controller 2000 determines that the paper jam has occurred at a position downstream from the cooling device 9 in the sheet conveying direction (NO in step S302), the sensor 500 has been turned on, and therefore the controller 2000 determines that there is a sheet P in the pair of holding/conveying belts 90 and a process of step S306 is then performed, which is described below. Therefore, the fixing device 8 and the cooling device 9 are driven continuously.

At step S305, the controller 2000 determines whether or not the sensor 500 turns on.

When the sensor 500 turns on (YES in step S305), the controller 2000 starts to determine to which the sheet P is discharged (i.e., to the sheet discharging tray 20 or the purge tray 1100).

When the sensor 500 is not turned on (NO in step S305), the controller 2000 determines whether or not the series of the image forming operations is completed, that is, whether or not there is a subsequent sheet P in the image forming apparatus 200 (step S315).

When the series of the image forming operations is not completed (NO in step S315), the above-described process of step S305 is performed again.

When the series of the image forming operations is completed (YES in step S315), the paper jam is notified to the users via the notification part 92 in a case in which the paper jam has occurred or YES in step S301 (step S324). When there is no paper jam in step S324, the image forming operation ends.

Here, after the process of step S305, it may be determined whether or not the sensor 510 turns on, which is the same as the processes of steps S220 and 221 as illustrated in FIG. 11B.

When the sensor 500 turns on by the jam causing sheet P (YES in step S306), it is highly likely the jam causing sheet P has defect on the image formed thereon or poor printing quality. Therefore, the controller 2000 determines that the sheet P is conveyed to the purge tray 1100 instead of the sheet discharging tray 20. Specifically, the switching claws 1201 and 1203 are switched to respective given sides to guide the sheet P to the purge tray 1100 (step S320). Then, the driving devices including the pair of holding/conveying belts 90 and the fixing device 8 disposed downstream from the paper jam point are continuously driven (step S321). Then, the controller 2000 determines whether or not a time from the start of continuation of the downstream driving devices exceeds a time the sheet P passes through the cooling device 9 (step S322).

When the continuation time of the downstream driving devices does not exceed the sheet passing time (NO in step S322), the process of step S322 is repeatedly performed until the continuation time exceeds the sheet passing time.

When the continuation time of the downstream driving devices exceeds the time the sheet P passes through the cooling device 9 (YES in step S322), the driving of the whole driving devices including the pair of holding/conveying belts 90 and the fixing roller 17 is stopped (step S323). Then, the paper jam is notified to the users via the notification part 92 in a case in which the paper jam has occurred or YES in step S301 (step S324). When there is no paper jam in step S324, the image forming operation ends.

When the sensor 500 turns on by a non-jam sheet P or a sheet P other than the jam causing sheet P (NO in step S306), the controller 2000 determines whether the printing mode is a single-side printing mode or a duplex side printing mode (step S307). After step S307, the controller 2000 determines whether the non-jam causing sheet P is conveyed to the purge tray 1100, the sheet discharging tray 20, or the duplex conveying path 1300 to print the second surface thereof.

When the printing mode is the single-side printing mode (YES in step S307), the controller 2000 determines whether any sheets P exist upstream from the jam causing sheet P in the sheet conveying direction (step S308).

When the sheets P exist not upstream but downstream from the jam causing sheet P in the sheet conveying direction (NO in step S308), the whole sheets P can be discharged to the sheet discharging tray 20 successfully. Therefore, the switching claw 1201 is switched to the given side to convey the sheets P to the sheet discharging roller pair 16 (step S309). Then, the driving devices including the pair of holding/conveying belts 90 and the fixing device 8 disposed downstream from the paper jam point are continuously driven (step S310), and the controller 2000 determines whether or not the time from the start of continuation of the downstream driving devices extends the time the sheet P passes through the cooling device 9 (step S311).

When the continuation time of the downstream driving devices does not exceed the sheet passing time (NO in step S311), the process of step S311 is repeatedly performed until the continuation time exceeds the sheet passing time.

When the continuation time of the downstream driving devices exceeds the sheet passing time (YES in step S311), the driving of the whole driving devices including the pair of holding/conveying belts 90 and the fixing roller 17 is stopped (step S323). Then, the paper jam is notified to the users via the notification part 92 in a case in which the paper jam has occurred or YES in step S301 (step S324). When there is no paper jam in step S324, the image forming operation ends.

By contrast, when the sheet P exists upstream from the jam causing sheet P in the sheet conveying direction (YES in step S308), the process of step S320 is taken.

When the printing mode is the duplex printing mode (NO in step S307), the controller 2000 determines whether or not the second surface of the sheet P has already been printed (step S325).

In the duplex printing mode (NO in step S307), the sheet P cannot be discharged to the sheet discharging tray 20 unless the printing of the second surface of the sheet P is completed. Therefore, when the controller 2000 determines that the second surface of the sheet P has been printed (YES in step S325), the controller 2000 determines whether or not the sheet P can be discharged to the sheet discharging tray 20 (step S326).

When the sheet P can be discharged to the sheet discharging tray 20 (YES in step S326), the switching claw 1201 is switched to the given side to convey the sheets P to the sheet discharging roller pair 16 (step S309).

Even when the second surface of the sheet P has been printed (YES in step S325), in a case in which the sheet P cannot be discharged to the sheet discharging tray 20 due to possible disarrangement of the page order (NO in step S326), the switching claws 1201 and 1203 are switched to respective given sides to guide the sheet P to the purge tray 1100 (step S320).

Further, when the second surface of the sheet P has not yet been printed (NO in step S325), the controller 2000 determines whether or not the sheet P can be discharged after printing the second surface (step S327).

When the sheet P cannot be discharged after printing the second surface of the sheet P due to disarrangement of the page sequence (NO in step S327), the switching claws 1201 and 1203 are switched to respective given sides to guide the sheet P to the purge tray 1100 (step S320).

By contrast, when the sheet P can be discharged after printing the second surface thereof (YES in step S327), the controller 2000 continues to perform the image forming operation of the second surface of the sheet P.

At this time, the controller 2000 determines whether the process of step S304 is previously taken to stop driving the devices and components at and upstream from the paper jam point (step S328).

When the process of step S304 is previously taken (YES in step S328), the printing of the second surface of the sheet P cannot be performed and the switching claws 1201 and 1203 are switched to respective given sides to guide the sheet P to the purge tray 1100 (step S320).

When the process of step S304 is not taken (NO in step S328), the devices and components disposed in the sheet conveying path R, and therefore the image forming operation for the second surface of the sheet P can be continued. Thereafter, the switching claws 1201 and 1202 are switched to respective given sides to guide the reverse path 1204 and the duplex conveying path 1300, respectively (step S329). Then, the sheet P is guided to the sheet conveying path R to print the second surface of the sheet P (step S330), and the process of step S301 is then performed.

When no paper jam occurs (NO in step S301) and the series of image forming operations is completed (YES in step S331), the image forming operation basically ends. In a case in which the paper jam has occurred, the paper jam is notified to the users via the notification part 92 (step S324). When there is no paper jam in step S324, the image forming operation ends.

How to detect whether or not the sheet P exists in the pair of holding/conveying belts 90 is not limited to the control flow illustrated in FIGS. 16A through 16C. For example, the control flows illustrated in FIGS. 3-5, 7-9, 12, and 14B can be applied to this embodiment.

Further, when the pair of holding/conveying belts 90 is continuously driven in steps S310 and S321, the continuation time in step S311 and S322 to determine whether or not the continuation time of the downstream driving devices exceeds the a time the sheet passing time passing through the cooling device 9 can be determined by using the first conveying time Ti and the second conveying time T2.

FIG. 17 is a diagram illustrating a block diagram of a controller and connected devices of the image forming apparatus 200 according to an embodiment.

The controller 2000 performs each control and determination of the devices and components (for example, starts and stops of driving the holding/conveying belt driving device 91, the fixing device drive device 81, the transfer device drive device 71, the switching claws 1201, 1202, 1203, and 1208, the conveying roller pairs 1207, 1205, 1301, the sheet discharging roller pair 16, the registration roller pair 15, and the sheet feed roller 14 and executing or not executing the notification part 92) in the above-described control flows.

Information (such as the state of the sensor ON or ON/OFF) of the first sheet detector (i.e., the sensor 500), the second sheet detector (i.e., the sensor 510), the third sheet detector (i.e., the sensor 520), the fourth sheet detector (i.e., the sensor 1000) are input to the controller 2000. After receiving the information of the sensor ON state, the controller 2000 receives information from the timer 85. When the sensor ON state is not normal (for example, when the timer 85 measures a time exceeding the time of the normal sensor ON state), the controller 2000 determines that the paper jam has occurred at the sheet detector or the sensor. When the paper jam is determined, each control is conducted according to the above-described control flows.

In the cooling device 9 employing a belt system as described above, each of the heat exchanging bodies 19*a* and 19*b* may be an air-cooled heat sink, a liquid-cooled plate, a heat exchanging body using Peltier elements, or a cooling plate with a heat-absorbing end of a heat pipe embedded therein. The heat pipe has the heat-absorbing end and a heat-radiating end embedded.

The sheet discharging part is not limited to the sheet discharging tray 20 that stores the sheet P. For example, a post-processing device that performs given post processes of the sheet P discharged from the apparatus body 201 may be provided to the image forming apparatus 200.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet conveying device comprising:

a fixing device to fix an image to a sheet;

a holding/conveying belt device having a plurality of belts to convey the sheet discharged from the fixing device to a downstream side of the fixing device in a sheet conveying direction while sandwiching the sheet between the belts; and a first sheet detector to detect whether the sheet exists in the holding/conveying belt device, wherein, when there is a paper jam upstream of the holding/conveying belt device and the first sheet detector detects the sheet, the fixing device and the holding/conveying belt device are continuously driven for a given time, wherein, when there is a paper jam upstream of the holding/conveying belt device and the first sheet detector does not detect the sheet, the fixing device and the holding/conveying belt device are immediately stopped.

2. The sheet conveying device according to claim 1, wherein the first sheet detector is a sensor disposed between the fixing device and the holding/conveying belt device.

3. The sheet conveying device according to claim 2, wherein:

the fixing device is stopped in the event of the paper jam when the sensor does not detect the sheet, and the holding/conveying belt device is driven for a given time without determination of whether the sheet exists in the holding/conveying belt device.

4. The sheet conveying device according to claim 2, wherein, in the event of the paper jam, in a case in which the sensor does not detect the sheet and the given time has not yet elapsed after the sheet has passed the sensor, the holding/conveying belt device is driven for the given time.

5. The sheet conveying device according to claim 2, wherein, when a time in which the sheet immediately before the paper jam has passed the sensor is greater than the given time, driving of the holding/conveying belt device is stopped.

6. The sheet conveying device according to claim 2, wherein, in a case in which the paper jam is determined based on a detection result obtained by the sensor, wherein:

when the sensor detects the sheet, the fixing device and the holding/conveying belt device are continuously driven for a given time, when the sensor does not detect the sheet, driving of the fixing device is stopped, and when the sheet exists in the holding/conveying belt device, the holding/conveying belt device is driven to rotate for the given time.

7. An image forming apparatus comprising:

an image forming part to form an image on a surface of a sheet; and the sheet conveying device according to claim 1 to convey the sheet having the image formed by the image forming part thereon.

8. The image forming apparatus according to claim 7, wherein, when the fixing device or the holding/conveying belt device is stopped, the paper jam is notified to a user by notification.

9. The image forming apparatus according to claim 7 further comprising a controller to control processes in a control flow.

10. The sheet conveying device according to claim 1, further comprising a second sheet detector disposed at an exit of the conveying belt, wherein, when the first sheet detector detects the sheet, it is determined that the sheet exists in the holding/conveying belt device, wherein, in the event of the paper jam, when at least one of the first sheet detector and the second sheet detector detects the sheet, the holding/conveying belt device is continuously driven for a given time after the second sheet detector has detected the sheet.

11. The sheet conveying device according to claim 1, further comprising a third sheet detector disposed upstream from the holding/conveying belt device in the sheet conveying direction, wherein, in the event of the paper jam, when either one of the first sheet detector and the third sheet detector has detected that there is the sheet left downstream from a paper jam point, the fixing device and the holding/conveying belt device related to sheet conveyance of the sheet left downstream from the paper jam point are continuously driven.

12. The sheet conveying device according to claim 1, further comprising a second sheet detector disposed at an exit of the holding/conveying belt device and a fourth sheet detector disposed downstream from the second sheet detector in the sheet conveying direction, wherein, when the first sheet detector detects the sheet, it is determined that the sheet is in the holding/conveying belt device, wherein, in the event of the paper jam, when at least one of the first sheet detector and the second sheet detector detects the sheet, the holding/conveying belt device is continuously driven from when the second sheet detector detects the sheet to when the fourth sheet detector detects the sheet.

13. The sheet conveying device according to claim 1, wherein after or while the fixing device and the holding/conveying belt device are continuously driven for the given time, when a subsequent sheet is detected by the sheet detector again, driving of the fixing device and the holding/conveying belt device is continued for a given additional time.

14. The sheet conveying device according to claim 1, further comprising:

a sheet discharging part disposed downstream from the holding/conveying belt device in the sheet conveying direction to discharge the sheet outside the sheet conveying device; and a sheet container disposed in the sheet conveying device to contain multiple recording media, wherein, in the event of the paper jam, when the sheet detector detects the sheet, the fixing device and the holding/conveying belt device are continuously driven for a given time, and the sheet is discharged to either one of the sheet discharging part and the sheet container.

15. The sheet conveying device according to claim 1, further comprising:

a cooler to cool the sheet, after the sheet passes through the fixing device.

16. The sheet conveying device according to claim 15, wherein the holding/conveying belt device comprises the cooler.

17. A method of conveying a sheet in an image forming apparatus which includes a fixing device to fix an image to a sheet, a holding/conveying belt device having a plurality of belts to convey the sheet discharged from the fixing device to an downstream side of the fixing device in a sheet conveying direction while sandwiching the sheet between the belts, a first sheet detector to detect whether the sheet exists in at least one of the holding/conveying belt device and at a position between the fixing device and the holding/conveying belt device; and a controller, the method comprising:

detecting a paper jam which is upstream of the first sheet detector and in the image forming apparatus;

detecting, by the first sheet detector, the sheet at either one of a position in the holding/conveying belt device and a position between the fixing device and the holding/conveying belt device;

continuing driving at least one of the holding/conveying belt device and the fixing device when the first sheet detector detects that the sheet exists at either one of the position in the holding/conveying belt device and the position between the fixing device and the holding/conveying belt device, when the paper jam was detected; and immediately stopping driving the at least one of the holding/conveying belt device and the fixing device when the first sheet detector detects that the sheet exists at either one of the position in the holding/conveying belt device and the position between the fixing device and the holding/conveying belt device, when the paper jam was detected.

18. The method of conveying the sheet according to claim 17, further comprising stopping the driving of the at least one of the fixing device and the holding/conveying belt device after detecting that there is no sheet left in the holding/conveying belt device.

19. The method of conveying the sheet according to claim 17, further comprising stopping the driving of the fixing device and continuing the driving of the holding/conveying belt device when no sheet exists between the fixing device and the holding/conveying belt device.

20. The method of conveying the sheet according to claim 19, further comprising continuously driving the holding/conveying belt device for a given time before stopping the driving of the holding/conveying belt device.

* * * * *